US012708862B2

(12) United States Patent
Enderschmidt et al.

(10) Patent No.: US 12,708,862 B2
(45) Date of Patent: Aug. 18, 2026

(54) ASSEMBLY WITH OBJECT IN HOUSING

(71) Applicant: Spin Master Ltd., Toronto (CA)

(72) Inventors: Chris Enderschmidt, Oakland, CA (US); David Durran, Pleasanton, CA (US); Hamid R. Hashemi, Toronto (CA); Graham Browning, Toronto (CA); Goran Markovic, Toronto (CA); Mollie Jameson, Toronto (CA); Stephani Belmonte, Toronto (CA); Russell G. Rasmussen, Pleasanton, CA (US)

(73) Assignee: Spin Master Ltd., Toronto (CA)

( * ) Notice: Subject to any disclaimer, the term of this patent is extended or adjusted under 35 U.S.C. 154(b) by 169 days.

(21) Appl. No.: 18/434,063

(22) Filed: Feb. 6, 2024

(65) Prior Publication Data

US 2025/0249372 A1 Aug. 7, 2025

(51) Int. Cl.

| | |
|---|---|
| ***A63H 33/26*** | (2006.01) |
| ***A63H 3/00*** | (2006.01) |
| ***A63H 3/50*** | (2006.01) |
| ***A63H 29/22*** | (2006.01) |

(52) U.S. Cl.

CPC ..... *A63H 33/26* (2013.01); *A63H 3/006* (2013.01); *A63H 3/50* (2013.01); *A63H 29/22* (2013.01)

(58) Field of Classification Search

CPC . A63H 3/006; A63H 3/36; A63H 3/50; A63H 29/22; A63H 33/22; A63H 33/26; A63H 2200/00

USPC ..... 446/71, 73, 310, 484, 485

See application file for complete search history.

(56) References Cited

U.S. PATENT DOCUMENTS

| | | | | |
|---|---|---|---|---|
| 608,794 | A | 8/1898 | Quinn | |
| 685,345 | A | 10/1901 | Perkins et al. | |
| 722,731 | A | 3/1903 | Mackaye | |
| 1,237,954 | A | 8/1917 | Prevost | |
| 2,722,773 | A * | 11/1955 | Bonanno | A63H 33/30 446/483 |
| 3,005,284 | A | 10/1961 | Angelo | |
| 3,091,053 | A | 5/1963 | Growald | |
| 3,139,697 | A | 7/1964 | Mier | |
| 3,181,271 | A * | 5/1965 | Withams | A63H 33/22 446/219 |
| 4,091,929 | A | 5/1978 | Krane | |

(Continued)

FOREIGN PATENT DOCUMENTS

| | | | |
|---|---|---|---|
| CN | 2135170 | Y | 6/1993 |
| CN | 2299836 | Y | 12/1998 |

(Continued)

*Primary Examiner* — Alexander R Niconovich

(74) *Attorney, Agent, or Firm* — Aird & Berlis LLP

(57) ABSTRACT

In an aspect, a toy assembly is provided, and includes a housing, an inner object, a sensor, an LED, and a control system. The housing is light transmissive, and has a light transfer member inside having a light inlet and a light outlet, positioned to direct light into the housing so as to render the light visible. The LED directs light at the light inlet of the light transfer member so as to transmit the light through it into and through the housing so as to be visible from the exterior of the housing. The control system is programmed to execute instructions, to operate the at least one light emitting element if a condition is met.

7 Claims, 25 Drawing Sheets

(56) References Cited

U.S. PATENT DOCUMENTS 4,097,917 A * 6/1978 McCaslin ..... G02B 6/0005 446/175
4,194,318 A * 3/1980 Watanabe ..... A63H 17/26 446/296
4,237,648 A 12/1980 Goldfarb
4,259,805 A 4/1981 Hornsby, Jr.
4,521,205 A * 6/1985 Spector ..... A63H 3/006 360/79
4,575,348 A 3/1986 Wiggs
4,591,345 A 5/1986 Kohner
4,698,043 A * 10/1987 May ..... A63H 33/005 446/273
4,729,069 A * 3/1988 Von Kohorn ..... G02B 6/0001 362/805
4,736,943 A * 4/1988 Fukuda ..... A63H 33/00 472/54
4,758,198 A 7/1988 Ishiwa
4,817,936 A * 4/1989 Matsuda ..... A63H 33/005 446/355
4,828,527 A * 5/1989 Spector ..... A63H 3/28 446/302
4,836,821 A 6/1989 Raymond
4,881,915 A 11/1989 Liaw
5,091,833 A * 2/1992 Paniaguas ..... F21V 33/0028 428/17
5,120,263 A 6/1992 Ierfino
5,263,889 A * 11/1993 Ledonne ..... A63H 33/00 446/75
5,451,180 A * 9/1995 Chan ..... A63H 13/00 40/411
5,522,758 A * 6/1996 Liu ..... A63H 13/00 40/411
5,545,069 A * 8/1996 Glynn ..... A63H 3/00 446/76
5,597,230 A * 1/1997 Newman ..... A45C 15/06 362/184
5,782,698 A * 7/1998 Keller ..... B44C 5/06 472/63
5,795,209 A * 8/1998 Moore ..... A63H 37/00 446/485
5,813,895 A 9/1998 Cho
5,989,092 A * 11/1999 McGowan ..... A63H 33/003 446/175
6,012,820 A * 1/2000 Weber ..... A63B 15/02 446/485
6,036,576 A * 3/2000 Colon, Jr. ..... A63H 33/009 446/485
6,082,876 A * 7/2000 Hanson ..... F21V 9/45 362/186
6,171,166 B1 1/2001 Oquita
6,210,250 B1 * 4/2001 Sui ..... G09F 19/02 446/330
6,231,346 B1 * 5/2001 Sagi-Dolev ..... G09B 23/00 446/73
6,238,261 B1 * 5/2001 Lang ..... A63H 33/22 446/485
6,250,985 B1 6/2001 Nicholson
6,312,308 B1 11/2001 Chen
6,592,426 B2 * 7/2003 Mesch ..... A63H 33/26 446/175
6,648,713 B1 11/2003 Oquita
6,702,644 B1 3/2004 Hornsby
6,761,612 B1 7/2004 Pencil
6,811,279 B2 * 11/2004 Coleman ..... A63H 37/00 426/104
7,086,770 B2 * 8/2006 Tell ..... G02B 6/0073 40/442
7,654,023 B2 * 2/2010 Peters ..... G09F 9/305 40/564
7,726,830 B2 * 6/2010 Yang ..... B44C 5/005 362/101
8,974,264 B2 3/2015 Mccafferty
9,550,128 B1 * 1/2017 Pruzansky ..... A63H 3/50
9,643,096 B1 * 5/2017 McDonald ..... A63H 3/36
9,720,378 B2 * 8/2017 Hills ..... G04F 1/00
9,724,616 B1 * 8/2017 Pedersen ..... A63H 27/10
9,757,659 B2 * 9/2017 Hashemi ..... A63H 3/52
9,814,995 B2 11/2017 McDonald
9,950,267 B2 4/2018 McDonald
10,238,981 B2 3/2019 McDonald
10,398,994 B1 * 9/2019 Cumings ..... A63H 3/50
10,421,026 B2 9/2019 Hashemi
10,807,011 B2 10/2020 McDonald
10,982,826 B2 * 4/2021 Bihong ..... F21L 4/00
11,400,386 B2 8/2022 McDonald
12,179,127 B2 * 12/2024 Kronberger ..... A63H 33/22
12,458,900 B2 * 11/2025 Tankel ..... A63H 3/50
2001/0034178 A1 10/2001 Spector
2002/0098770 A1 7/2002 Mesch
2004/0127140 A1 7/2004 Kelly et al.
2005/0075041 A1 4/2005 Norman
2006/0030236 A1 2/2006 Ueno et al.
2007/0049162 A1 * 3/2007 Liao ..... A63H 29/22 446/487
2007/0102308 A1 5/2007 Tremblay et al.
2007/0173170 A1 7/2007 Wu
2008/0014831 A1 1/2008 Rettberg et al.
2013/0296140 A1 * 11/2013 Publicover ..... A63B 43/06 239/289
2016/0114256 A1 * 4/2016 Binder ..... H02J 50/10 446/175
2016/0169463 A1 * 6/2016 Gunderson ..... F21S 6/00 362/157
2017/0307965 A1 * 10/2017 Sum ..... A63H 3/006
2020/0016505 A1 1/2020 Adler
2020/0261814 A1 * 8/2020 Pruzansky ..... A63H 29/24
2023/0111031 A1 * 4/2023 Kelly ..... A63H 33/22 446/219
2023/0277954 A1 * 9/2023 Kelly ..... A63H 30/04 446/15
2025/0360428 A1 * 11/2025 Patton ..... A47F 11/10

FOREIGN PATENT DOCUMENTS

CN 2313646 Y 4/1999
CN 2617448 Y 5/2004
CN 2750846 Y 1/2006
CN 2834651 Y 11/2006
CN 200970478 Y 11/2007
CN 102475981 A 5/2012
CN 202478611 U 10/2012
EP 206500 A1 12/1986
EP 420386 A1 4/1991
FR 1164900 A 10/1958
FR 2554360 A1 5/1985
GB 2189710 A 11/1987
GB 2355940 A 5/2001
GB 2367766 A 4/2002
GB 2537604 A 10/2016
JP S62200392 U 12/1987
JP H02252485 A 10/1990
JP H02141495 U 11/1990
JP H037886 U 1/1991
JP H10286382 A 10/1998
JP 2002224463 A 8/2002
JP 2002536031 A 10/2002
JP 2004035829 A 2/2004
JP 2009095283 A 5/2009
JP 2012157565 A 8/2012
KR 20000020343 U 12/2000
KR 2003867931 Y 6/2005
TW M279395 U 11/2005
WO 2004041388 A1 5/2004
WO 2010045268 A1 4/2010

* cited by examiner

ASSEMBLY WITH OBJECT IN HOUSING

FIELD

The specification relates generally to assemblies with inner objects inside housings, and more particularly to a toy character in a housing shaped like an egg.

BACKGROUND OF THE DISCLOSURE

There is a continuing desire to provide toys that interact with a user, and for the toys to reward the user based on the interaction. For example, some robotic pets will show simulated love if their owner pats their head several times. While such robotic pets are enjoyed by their owners, there is a continuing desire for new and innovative types of toys and particularly toy characters that interact with their owner.

SUMMARY OF THE DISCLOSURE

In a first aspect, a toy assembly is provided, and includes a housing, an inner object (which may, in some embodiments, be a toy character), at least one sensor, at least one light emitting element, and a control system. The housing includes a first housing member and a second housing member. The first housing member is light transmissive to an exterior of the housing, and a light transfer member having a light inlet and a light outlet. The light outlet is positioned to direct light into the first housing member so as to render the light visible from the exterior of the housing. The inner object is inside the housing. The inner object is removable from the housing. The at least one sensor detects interaction by a user with the housing. The at least one light emitting element is positioned on the inner object and is not visible from the exterior of the housing. The at least one light emitting element is positioned to direct light at the light inlet of the light transfer member so as to transmit the light through the light transfer member into the first housing member and through the first housing member so as to be visible from the exterior of the housing. The control system includes a processor and a memory connected to the processor. The processor is programmed to execute instructions stored in the memory, to determine whether a selected condition has been met based on signals from the at least one sensor, and to operate the at least one light emitting element if the condition is met.

In a second aspect, a toy assembly is provided, and includes a housing, an inner object (which may, in some embodiments, be a toy character), a motor, and a drive train. The inner object is inside the housing. The inner object is removable from the housing, and includes a breakout member. The motor includes a motor output shaft that is rotated at a motor output speed that is greater than 4000 rpm. The drive train includes a drive pulley that is mounted to the motor output shaft, a driven pulley, and a belt that extends between the drive pulley and the driven pulley. The drive pulley and the driven pulley have a size ratio such that the driven pulley rotates at a driven pulley speed that is less than 4000 rpm. The drive train further includes a gear train that includes a plurality of gears including at least a first gear that co-rotates with the driven pulley, and a final gear that is driven at least indirectly by the first gear. The plurality of gears all rotate at speeds that are less than 4000 rpm. The final gear is operatively connected to the breakout member. Operation of the motor drives the breakout member through the drivetrain, to move between a retracted position and an extended position in order to break the housing so as to expose the inner object.

In a third aspect, a toy character is provided and includes a toy character housing, defining a vertical axis, wherein the toy character housing includes a ground engagement surface that permits tipping of the toy character, a motor, a weighted arm with a weight thereon, a weighted arm driver, a weighted arm cam path and a weighted arm cam path engagement member. The weighted arm is movable to change a distance of the weight relative to the vertical axis. One of the weighted arm cam path and the weighted arm cam path engagement member is connected to the weighted arm, and the other of the weighted arm cam path and the weighted arm cam path engagement member is connected to the weighted arm driver. The motor is operatively connected to the weighted arm driver, such that rotation of the motor by a first amount in a first direction drives movement of the weighted arm driver, which in turn drives movement of the weighted arm cam path engagement member along a first portion of the weighted arm cam path, so as to move the weighted arm and the weight so as to move a center of gravity for the toy character to a first position that causes tipping of the toy character in a first tipping direction. Continued rotation of the motor by a second amount beyond the first amount in the first direction drives movement of the weighted arm driver, which in turn drives movement of the weighted arm cam path engagement member along a second portion of the weighted arm cam path, so as to move the weighted arm and the weight so as to move the center of gravity for the toy character to a second position that causes tipping of the toy character in a second tipping direction.

In a fourth aspect, a toy assembly is provided, and includes a housing, an inner object (which may, in some embodiments, be a toy character), and a motor. The housing includes a sun gear that is fixed in position and which defines an axis. The inner object is inside the housing and is removable from the housing. The inner object includes a breakout member, a leadscrew, a leadscrew nut, a planet gear, a rotary function shaft, a plunger, a plunger biasing member, and a carriage. The leadscrew nut is movably linearly along the leadscrew during rotation of the leadscrew. The planet gear is engaged with the sun gear and is rotatable to drive rotation of the inner object about the axis. The rotary function shaft has a first end that is operatively engaged with the planet gear, and a second end that includes at least one shaft tooth. The plunger has a first end and a second end. The plunger includes at least one plunger tooth at the first end. The at least one plunger tooth is releasably engageable with the at least one shaft tooth to operatively connect the plunger to the rotary function shaft. The plunger is axially slidable relative to the leadscrew but is rotationally connected to the leadscrew. The plunger biasing member is positioned to urge the plunger from a shaft engagement position in which the at least one plunger tooth is engaged with the at least one shaft tooth, towards a shaft release position in which the at least one plunger tooth is disengaged from the at least one shaft tooth. The carriage is connected to the leadscrew nut, and is connected to the breakout member. Rotation of the leadscrew in a first leadscrew direction drives the leadscrew nut linearly in a first nut direction, which in turn drives the carriage away from the plunger, permitting the plunger biasing member to drive the plunger to the shaft release position, thereby disconnecting the plunger from driving rotation of the planet gear, but driving movement of the breakout member to engage the housing to break the housing. Rotation of the leadscrew in a second leadscrew direction drives the leadscrew nut in a second nut direction, which in turn drives the carriage towards the plunger, driving the plunger to the shaft engagement position, thereby operatively connecting the plunger to drive rotation of the planet gear so as to rotate the inner object from a first rotational position to a second rotational position in the housing. The motor is operatively connected to the leadscrew for driving rotation of the leadscrew in the first and second directions.

In a fifth aspect, a toy assembly is provided, and includes a housing, an inner object (which may, in some embodiments, be a toy character), and a motor. The inner object is inside the housing and is removable from the housing. The inner object includes a first functional element that is movable linearly between a retracted position and an extended position to carry out a first function while the inner object is in the housing, a leadscrew, a leadscrew nut that is movably linearly along the leadscrew during rotation of the leadscrew, a second functional element that is rotatable and is movable via rotation from a first rotary position to a second rotary position to carry out a second function while the inner object is in the housing, a rotary function shaft that has a first end that is operatively engaged with the second functional element, and a second end that includes at least one shaft teeth, and a plunger having a first end and a second end. The plunger includes at least one plunger tooth at the first end. The at least one plunger tooth is releasably engageable with the at least one shaft tooth to operatively connect the plunger to the rotary function shaft. The plunger is axially slidable relative to the leadscrew but is rotationally connected to the leadscrew. The inner object further includes a plunger biasing member that is positioned to urge the plunger from a shaft engagement position in which the at least one plunger tooth is engaged with the at least one shaft tooth, towards a shaft release position in which the at least one plunger tooth is disengaged from the at least one shaft tooth, and a carriage that is connected to the leadscrew nut, and is connected to the first functional element. The carriage is movable between a first carriage position and a second carriage position. Rotation of the leadscrew in a first leadscrew direction drives the leadscrew nut in a first nut direction, which in turn drives the carriage away from the first carriage position to the second carriage position, and away from the plunger, permitting the plunger biasing member to drive the plunger to the shaft release position, thereby disconnecting the plunger from driving rotation of the second functional element. Movement of the carriage to the second carriage position drives movement of the first functional element linearly to the extended position. Rotation of the leadscrew in a second leadscrew direction drives the leadscrew nut in a second nut direction, which in turn drives the carriage to the first carriage position thereby driving the first functional element to the retracted position, and which drives the carriage to drive the plunger to the shaft engagement position, which operatively connects the plunger to the second functional element to drive rotation of the second functional element to move the second functional element from the first rotary position for the second functional element to the second rotary position for the second functional element, so as to carry out the second function. The motor is operatively connected to the leadscrew for driving rotation of the leadscrew in the first and second leadscrew directions.

In a fifth aspect, a toy assembly is provided, and includes a housing, and an inner object (which may, in some embodiments, be a toy character). The housing includes a base and an upper member. The inner object is inside the housing, and is removable from the housing. The housing includes a first latching member that is movable between an unlocking position for the first latching member and a locking position for the first latching member. In the unlocking position first latching member, the first latching member permits removal of the inner object from the housing. In the locking position for the first latching member, the first latching member engages a first latching member engagement surface on the inner object to prevent removal of the inner object from the housing. The housing includes a second latching member that is movable between an unlocking position for the second latching member and a locking position for the second latching member. In the unlocking position second latching member, the second latching member permits removal of the inner object from the housing. In the locking position for the second latching member, the second latching member engages a second latching member engagement surface on the inner object to prevent removal of the inner object from the housing. The housing further includes a first latching member holding member that holds the first latching member in the unlocking position for the first latching member, so as to inhibit the first latching member from moving to the locking position for the first latching member after moving to the unlocking position for the first latching member. The housing further includes a second latching member biasing member that urges the second latching member towards the locking position for the second latching member, so as to move towards the locking position for the second latching member after moving to the unlocking position for the second latching member. The second latching member includes a driven surface, and wherein the inner object has a driver surface. The driver surface is positioned to engage the driven surface to drive the second latching member away from the locking position for the second latching member during insertion of the inner object towards a mounted position in the base. The driver surface is positioned to disengage from the driven surface upon the inner object reaching the mounted position, so as to permit the second latching member biasing member to drive the second latching member to the locking position for the second latching member.

BRIEF DESCRIPTIONS OF THE DRAWINGS

For a better understanding of the various embodiments described herein and to show more clearly how they may be carried into effect, reference will now be made, by way of example only, to the accompanying drawings.

DETAILED DESCRIPTION

Figure 1:
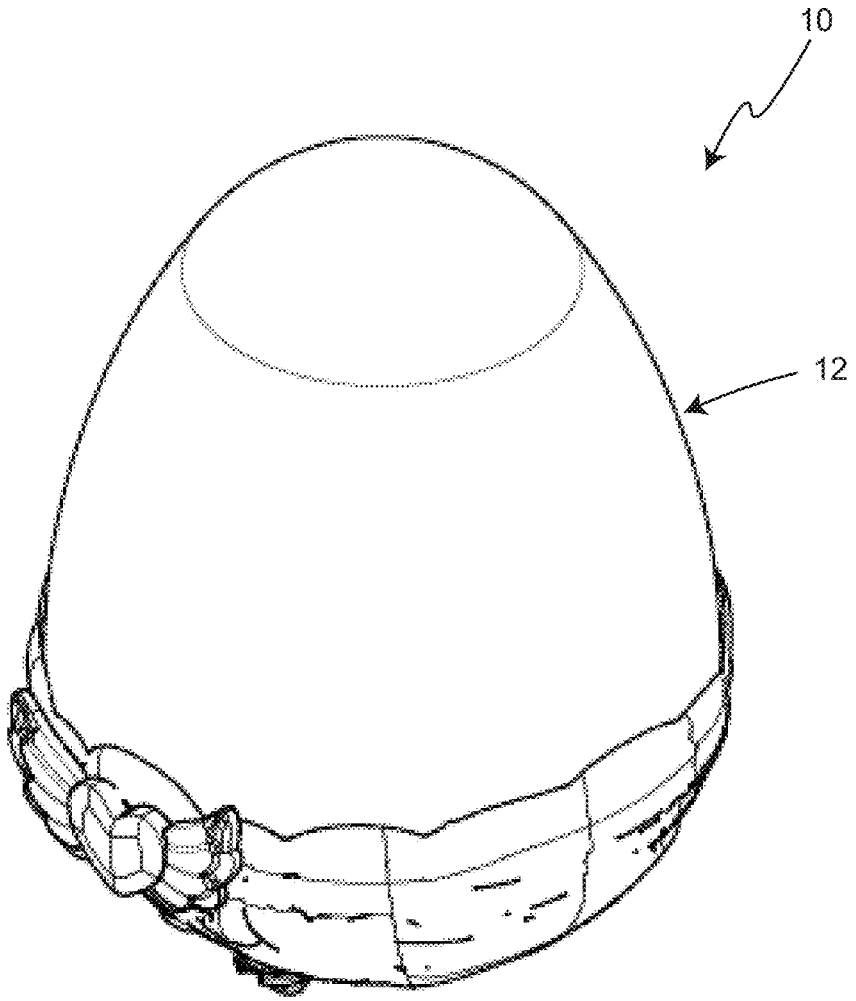
FIG. 1 is a perspective view of the toy assembly shown in FIG. 1, according to a non-limiting embodiment of the present disclosure.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

The terms 'comprising' and 'including' and their various conjugations (e.g. 'comprises') will be understood to be inclusive and open-ended, and not exclusive. This means that if an element A includes or comprises an element B, it will be understood that element A could include or comprise other elements in addition to including or comprising element B. The term 'having' and its various conjugations are also to be understood as being open-ended in the same way as 'comprising' and 'including'. These terms are not to be interpreted to exclude the presence of other features, steps or components.

As used herein, the terms "about" and "approximately" are meant to cover variations that may exist in the upper and lower limits of the ranges of values, such as variations in properties, parameters, and dimensions.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns such that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

As used in this document, "attached" in describing the relationship between two connected parts includes the case in which the two connected parts are "directly attached" with the two connected parts being in contact with each other, and the case in which the connected parts are "indirectly attached" and not in contact with each other, but connected by one or more intervening other part(s) between.

As used in this document, terms describing relative positions of elements such as 'top', 'upper', 'bottom', 'lower', or other analogous terms will be understood to refer to the placement of the described element during use of the apparatus of which it is a part unless the context would make it clear that it is otherwise. It will be understood that the aforementioned placement of an element, for example, can still be considered its placement even when the object that it is a part of is lying in some position other than the position in which it will be used. As an example, if reference is made to a device having an upper member, it will be understood that the upper member is being described as having an upper position when the device that it is a part of is in use or is in position for use, unless the context would make it clear that it is otherwise. Further to this example, it will be understood that the aforementioned upper member of the object can still be considered its upper member even when the object is lying on its side, for storage, or for transport, or for some other reason.

"Memory" refers to a non-transitory tangible computer-readable medium for storing information (e.g., data or data structures) in a format readable by a processor, and/or instructions (e.g., computer code or software programs or modules) that are readable and executable by a processor to implement an algorithm. The term "memory" includes a single device or a plurality of physically discrete, operatively connected devices despite use of the term in the singular. Non-limiting types of memory include solid-state semiconductor, optical, magnetic, and magneto-optical computer readable media. Examples of memory technologies include optical discs such as compact discs (CD-ROMs) and digital versatile discs (DVDs), magnetic media such as floppy disks, magnetic tapes or cassettes, and solid-state semiconductor random access memory (RAM) devices, read-only memory (ROM) devices, electrically erasable programmable read-only memory (EEPROM) devices, flash memory devices, memory chips and combinations of the foregoing. Memory may be non-volatile or volatile. Memory may be physically attached to a processor, or remote from a processor. Memory may be removable or non-removable from a system including a processor. Memory may be operatively connected to a processor in such as way as to be accessible by a processor. Instructions stored by a memory may be based on a plurality of programming and/or markup languages known in the art, with non-limiting examples including the C, C++, C#, Python™, MATLAB™, Java™, JavaScript™, Perl™, PHP™, SQL™, Visual Basic™, Hypertext Markup Language (HTML), Extensible Markup Language (XML), and combinations of the foregoing. Instructions stored by a memory may also be implemented by configuration settings for a fixed-function device, gate array or programmable logic device.

"Processor" refers to one or more electronic hardware devices that is/are capable of reading and executing instructions stored on a memory to perform operations on data, which may be stored on a memory or provided in a data signal. The term "processor" includes a single device or a plurality of physically discrete, operatively connected devices despite use of the term in the singular. The plurality of processors may be arrayed or distributed. Non-limiting examples of processors include integrated circuit semiconductor devices and/or processing circuit devices referred to as computers, servers or terminals having single or multi-processor architectures, microprocessors, microcontrollers, microcontroller units (MCU), central processing units (CPU), field-programmable gate arrays (FPGA), application specific circuits (ASIC), digital signal processors, and combinations of the foregoing.

Any method, application or module herein described may be implemented using computer readable/executable instructions that may be stored or otherwise held by a memory, and executed by a processor. Aspects of the present disclosure may be described with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor, such that the processor, and a memory storing the instructions, which execute via the processor, collectively constitute a machine for implementing the functions/acts specified in the flowchart and/or block diagram block or blocks.

The flowcharts and functional block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The embodiments of the disclosures described herein are exemplary (e.g., in terms of materials, shapes, dimensions, and constructional details) and do not limit by the claims appended hereto and any amendments made thereto. Persons skilled in the art will appreciate that there are yet more alternative implementations and modifications possible, and that the following examples are only illustrations of one or more implementations. The scope of the disclosure, therefore, is only to be limited by the claims appended hereto and any amendments made thereto.

Figure 2:
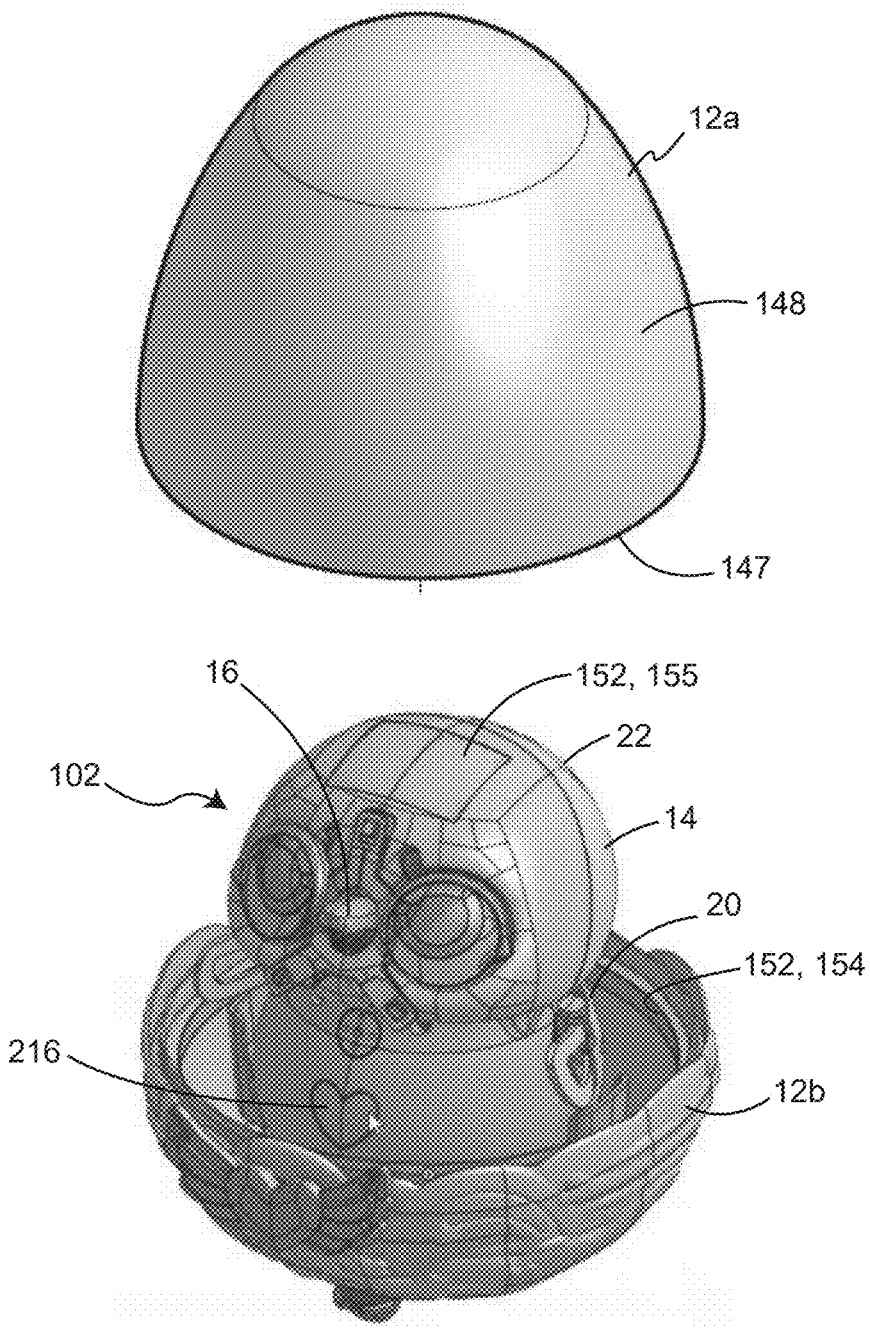
FIG. 2 is a perspective view of the toy assembly shown in FIG. 1, with a housing shown partially exploded so as to show an inner object therein.
Figure 3:
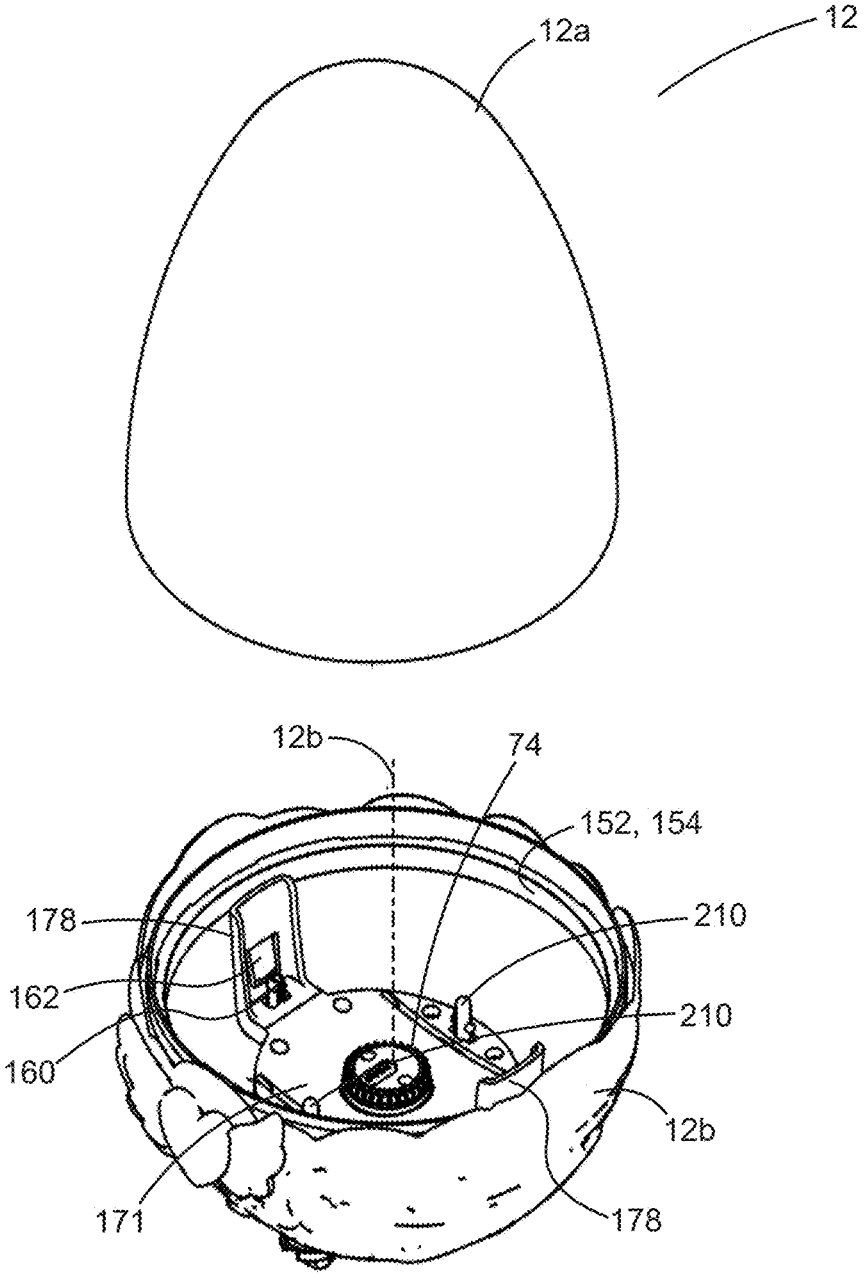
FIG. 3 is a perspective view of the housing from the toy assembly shown in FIG. 1, partially exploded.

Reference is made to FIGS. 1 and 2, which show a toy assembly 10 in accordance with an embodiment of the present disclosure. The toy assembly 10 includes a housing 12 and an inner object 14 (FIG. 2) that is positioned in the housing 12. The housing 12 may also be referred to as the toy assembly housing 12, to better distinguish it from other housings that are introduced elsewhere in the specification.

The housing 12 may be opaque in the sense that, under typical diffuse ambient lighting conditions, the inner object 14 would be not visible to a user through the housing 12, so that the identity of the inner object remains a surprise to the user of the toy assembly 10 until the housing 12 is opened (e.g. by breaking the housing). Alternatively, the housing 12 may be translucent, or transparent. In the embodiment shown, the housing 12 includes a plurality of housing members, including a first housing member 12*a*, and a second housing member 12*b*, which are fixedly joined together so as to enclose the toy character 14. The first housing member 12*a* is opaque under typical diffuse ambient lighting conditions, as noted above, but is light transmissive as is described further below. The first housing member 12*a* may be made from any suitable material, such as a composite material that contains about 66% polyethylene, about 28% Ethylene Vinyl Acetate, and about 6% C5 petroleum resin. The material of the first housing material may be provided so as to be breakable from a suitably light engagement force, during a breakout process, as is described further below. The first housing member 12*a* may also be referred to as an upper housing member 12*a* since in the embodiment shown, it is on top of the second housing member 12*b*.

In some embodiments, the base 12*b* of the housing 12 may be made from a base material that is unbreakable by the breakout process. This permits the base 12*b* to be reused as a holding place for the inner object 14 after play by the user with the inner object 14, and also may itself be involved in play by the user with the inner object 14 after the breakout process is completed.

The second housing member 12*b* may be opaque and non-light transmissive, and may be made from a material that is not easily breakable such as a suitable nylon or other tough polymeric material. Alternatively, the second housing member may be made from any other suitable material. The second housing member 12*b* may be referred to as a base 12*b* since the second housing member 12*b* may hold the inner object 14 therein.

In the embodiment shown, the housing 12 is in the form of an eggshell. However, the housing 12 may have any other suitable shape, such as a spherical shape, a cubic shape or any other regular or irregular shape.

The inner object 14 may have any suitable form. For example, the inner object may be a toy character and may thus be referred to as the toy character 14. The toy character may have any suitable form. For example, the toy character 14 may have the form of a bird, as shown in the figures, or may have the form of any other suitable animal, such as a dinosaur, a mammal such as a bear, or a reptile such as a lizard or a turtle. Alternatively, the toy character may have the form of a fictional animal such as a dragon. As another alternative, the toy character 14 may have the form of any other suitable object, such as a vehicle, a teapot, a robot, or any other suitable object. In embodiments in which the toy character 14 has the form of a non-living object such as a vehicle, it may be provided with features that give it the appearance of a living being, such as any one or more of: one or more eyes, a mouth, an appendage (e.g. a wing or an arm), or any other suitable feature.

Figure 31:
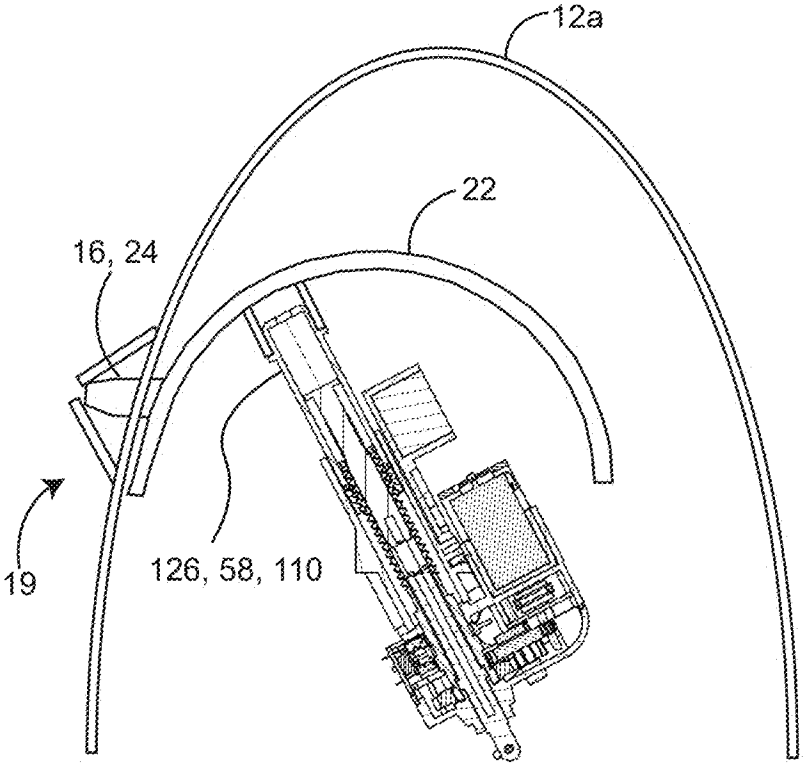
FIG. 31 is a side sectional view of the housing and the inner object, wherein the breakout member of the inner object is in an extended position, breaking the housing.
Figure 30:
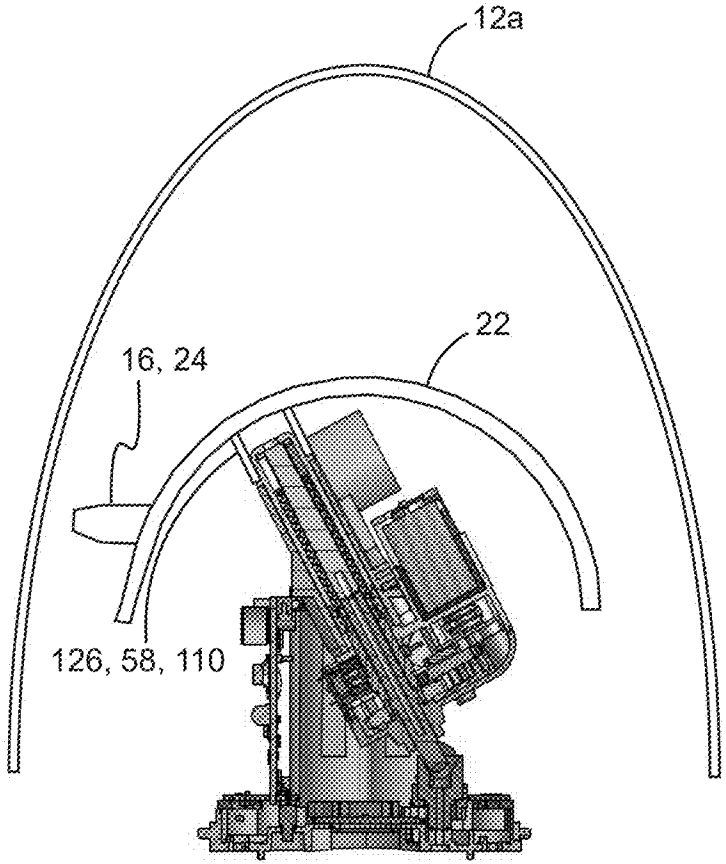
FIG. 30 is a side sectional view of the housing and the inner object, wherein a breakout member of the inner object is in a retracted position.

The inner object 14 may include a breakout member 16, a motor 17 (FIG. 7), and a drive train 18. The breakout member 16 (FIG. 2) is movable to engage the housing 12 (e.g. the first housing member 12*a*) so as to break the housing 12 to expose the inner object 14, as illustrated in FIGS. 30 and 31, where the housing 12 is broken by the breakout member 16 in FIG. 31. The break in the housing 12 is shown at 19. In the embodiment shown, the breakout member 16 is a portion of the inner object 14. More specifically, in the embodiment shown, the inner object 14 is in the form of a toy character, and includes a body 20 and a head 22, and the breakout member 16 is a portion of the head 22. More specifically, the head 22 may include a beak 24 and the breakout member 22 may be the beak 24.

Figure 7:
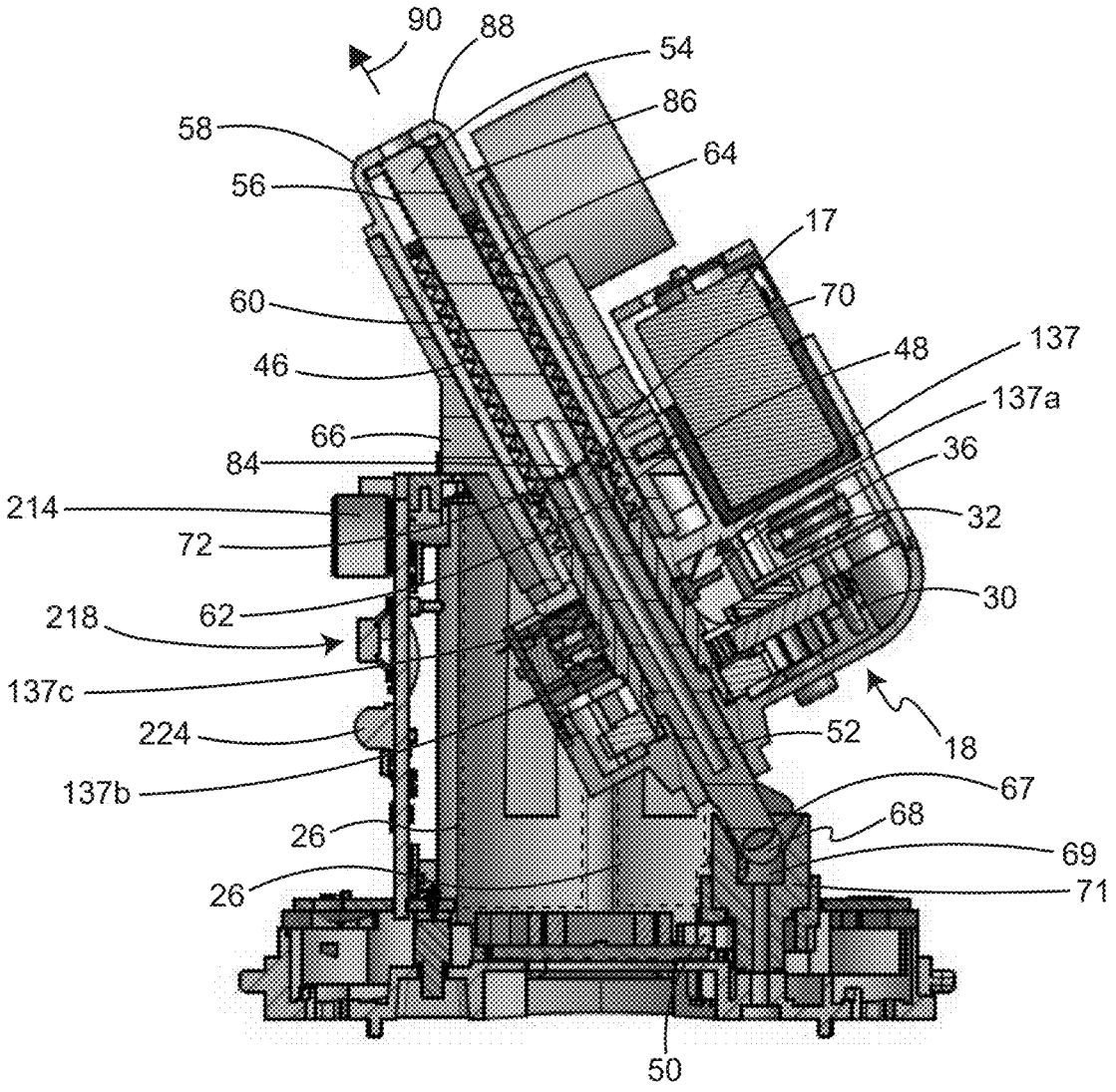
FIG. 7 is a sectional side view of a drive train from the inner object shown in FIG. 2, illustrating a carriage in a retracted position.
Figure 13:
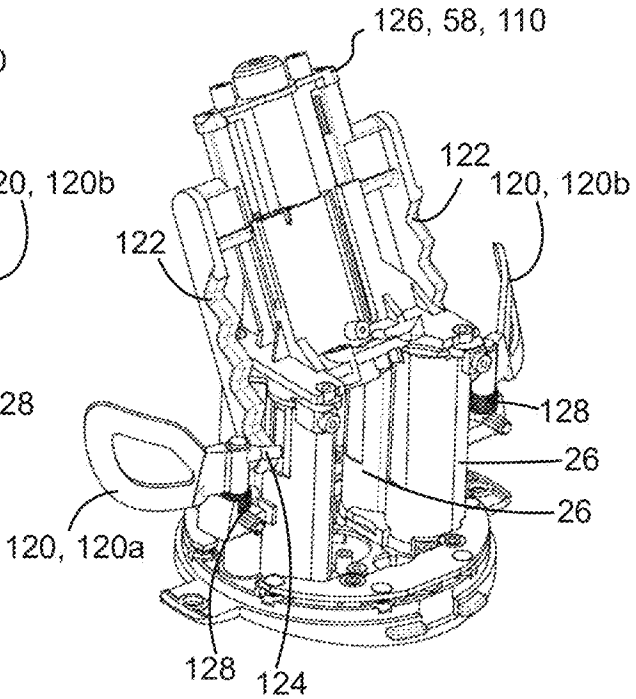
FIG. 13 is a perspective view of the interior of the inner object shown in FIG. 2, showing the drive train in the position shown in FIG. 10, with the carriage in the extended position.

Referring to FIG. 7, the motor 17 may be, for example, an electric motor or a spring motor (i.e. a spring, such as a clock spring, which is wound up by means of a key or the like, and is then released to drive rotation of a shaft). In embodiments in which the motor 17 is an electric motor, the inner object 14 may further include at least one battery 26 that is operatively connected to the motor 17 to power operation of the motor 17. As shown in FIGS. 7 and 13 the at least one battery 26 is a plurality of batteries 26. In embodiments in which the motor 17 is an electric motor, the motor 17 may be a bi-directional electric motor.

Figure 8:
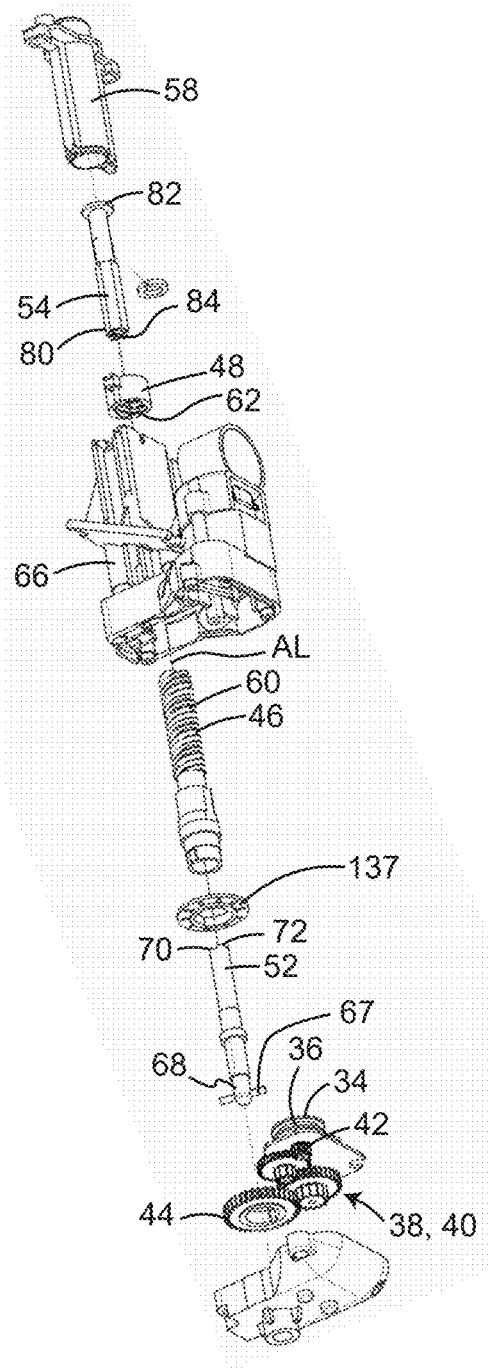
FIG. 8 is a perspective view of the drive train shown in FIG. 7, partially exploded.

The motor 17 is operatively connected to the breakout member 16 by the drive train 18, as shown in FIG. 7. The drive train 18 may include any suitable combination of power transfer elements so as to operatively connect the motor 17 to the breakout member 16. In the embodiment shown, the motor 17 includes a motor output shaft 30, and the drive train 18 includes a drive pulley 32 that is mounted to the motor output shaft 30, for rotation therewith, as shown in FIG. 7. The drive train 18 further includes a driven pulley 34 (FIG. 8), a belt 36 that extends between the drive pulley 32 and the driven pulley 34, and a gear train 38 that includes a plurality of gears 40 including at least a first gear 42 that co-rotates with the driven pulley 34, and a final gear 44 that is driven at least indirectly (e.g. via one or more intermediate gears) by the first gear 42. The plurality of gears 40 may be made from any suitable material such as a polymeric material, such as Nylon.

The final gear 44 is operatively connected to the breakout member 16 in any suitable way. For example, the drive train 18 may include a leadscrew 46, a leadscrew nut 48, a planet gear 50, a rotary function shaft 52, a plunger 54, a plunger biasing member 56, and a carriage 58. The leadscrew 46 may include gear teeth thereon so as to be rotatable by the final gear 44 during rotation of the final gear 44. The leadscrew 46 includes a leadscrew thread 60. The leadscrew nut 48 has leadscrew nut thread 62 that is engageable with the leadscrew thread 60, and is mounted thereto and is mounted slidably in a nut aperture 64 in an inner body housing shown at 66, so as to be movable linearly along the leadscrew 46 during rotation of the leadscrew 46.

Figure 14:
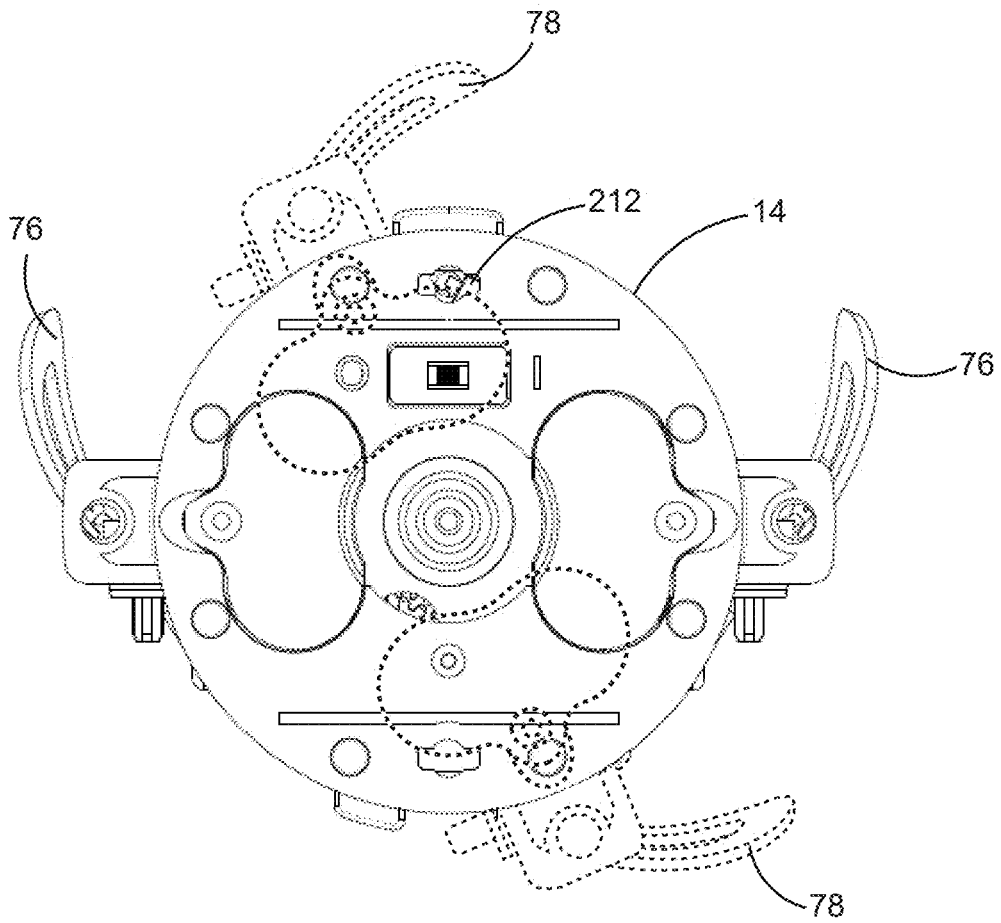
FIG. 14 is a bottom plan view of the inner object shown in FIG. 2 in two different orientations after rotating by a selected amount.

The rotary function shaft 52 has a first end 68 that is operatively engaged with the planet gear 50, and a second end 70 that includes at least one shaft tooth 72. The planet gear 50 is engaged with a sun gear 74 that is fixed in position and that defines an inner object rotation axis A. The sun gear 74 may, for example, be an element that is fixedly connected to the housing 12 (specifically the base 12*b*). Rotation of the planet gear 50 drives the planet gear 50 to orbit the sun gear 74, so as to rotate the inner object 14 from a first rotational position (shown at 76 in FIG. 14) to a second rotational position (shown at 78 in FIG. 14).

The operative engagement of the first end of the rotary function shaft 52 with the planet gear 50 may be by any suitable means, such as by providing a drive pin 67 through the rotary function shaft 52 at the first end 68, which engages a drive slot 69 in a rotary member 71 (shown best in FIGS. 7 and 19) that itself is operatively connected to the planet gear 50 (either directly by having the planet gear 50 on it directly, or by having gear teeth on it, that engage the planet gear or that engage one or more other gears that engage the planet gear 50).

The plunger 54 has a first end 80 and a second end 82. The plunger 54 includes at least one plunger tooth 84 at the first end 80. The at least one plunger tooth 84 is releasably engageable with the at least one shaft tooth 72 to operatively connect the plunger 54 to the rotary function shaft 52. In the embodiment shown, there are a plurality of shaft teeth 72 and a plurality of plunger teeth 84.

The plunger 54 is axially slidable relative to the leadscrew 46, but is rotationally connected to the leadscrew 46. In other words, rotation of the leadscrew 46 drives rotation of the plunger 54, but the plunger 54 is slidable axially along the leadscrew 46, (i.e. along an axis of the leadscrew 46, referred to as the leadscrew axis AL).

Figure 9:
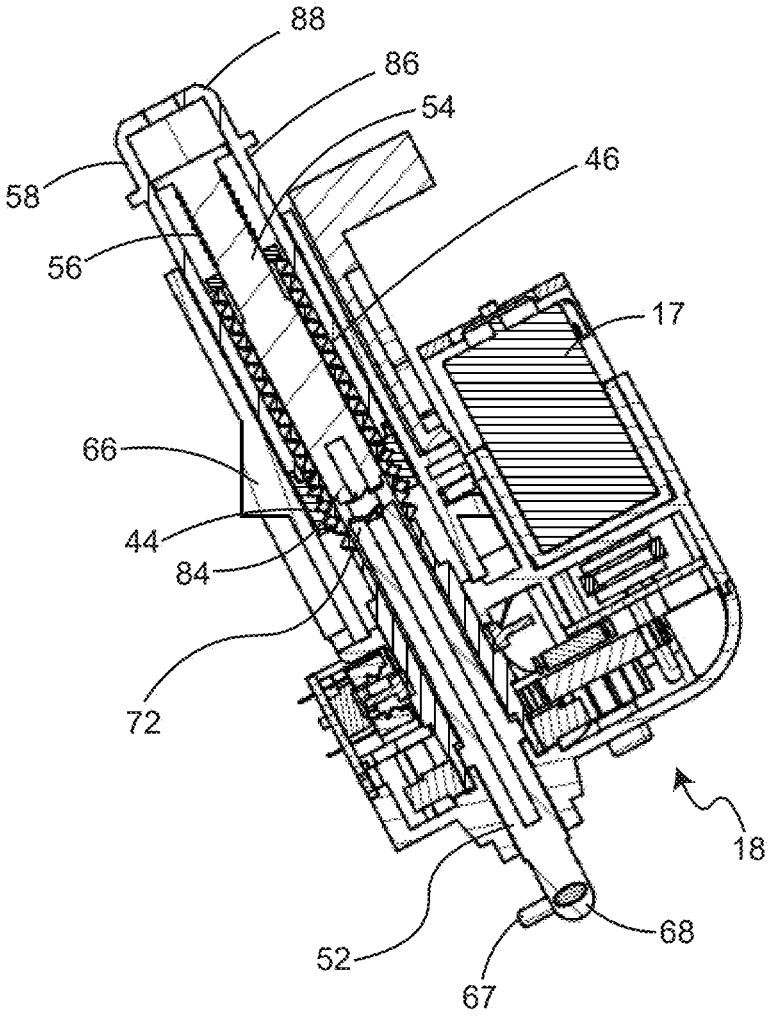
FIG. 9 is a sectional side view of the drive train from the inner object shown in FIG. 2, illustrating the carriage in an intermediate position.

The plunger biasing member 56 is positioned to urge the plunger 54 from a shaft engagement position (FIG. 7) in which the at least one plunger tooth 84 is engaged with the at least one shaft tooth 72, towards a shaft release position (FIG. 9) in which the at least one plunger tooth 84 is disengaged from the at least one shaft tooth 72. The plunger biasing member 56 may be any suitable type of biasing member such as, for example, a compression spring or any other suitable type of spring.

The carriage 58 is connected to the leadscrew nut 48, and is connected to the breakout member 16. In the embodiment shown, the carriage 58 includes a sleeve 86 with a driver end 88. The sleeve 86 surrounds the leadscrew 46, and extends in the nut aperture 64 with the leadscrew nut 48. The driver end 88 is engageable with, or disengageable from, the plunger 54 to either drive the plunger 54 towards the shaft engagement position, or to permit movement of the plunger 54 towards the shaft release position.

Rotation of the leadscrew 46 in a first leadscrew direction (e.g. counterclockwise in the view shown in FIG. 8) drives the leadscrew nut 48 linearly in a first nut direction (shown at 90 in FIG. 7), which in turn drives the carriage 58 away from the plunger 54 to a first function position, permitting the plunger biasing member 56 to drive the plunger 54 to the shaft release position (FIG. 9), thereby disconnecting the plunger 54 from driving rotation of the planet gear 50, but which drives movement of the breakout member 16 linearly from a retracted position to an extended position to engage the housing 12 so as to break the housing 12.

Figure 10:
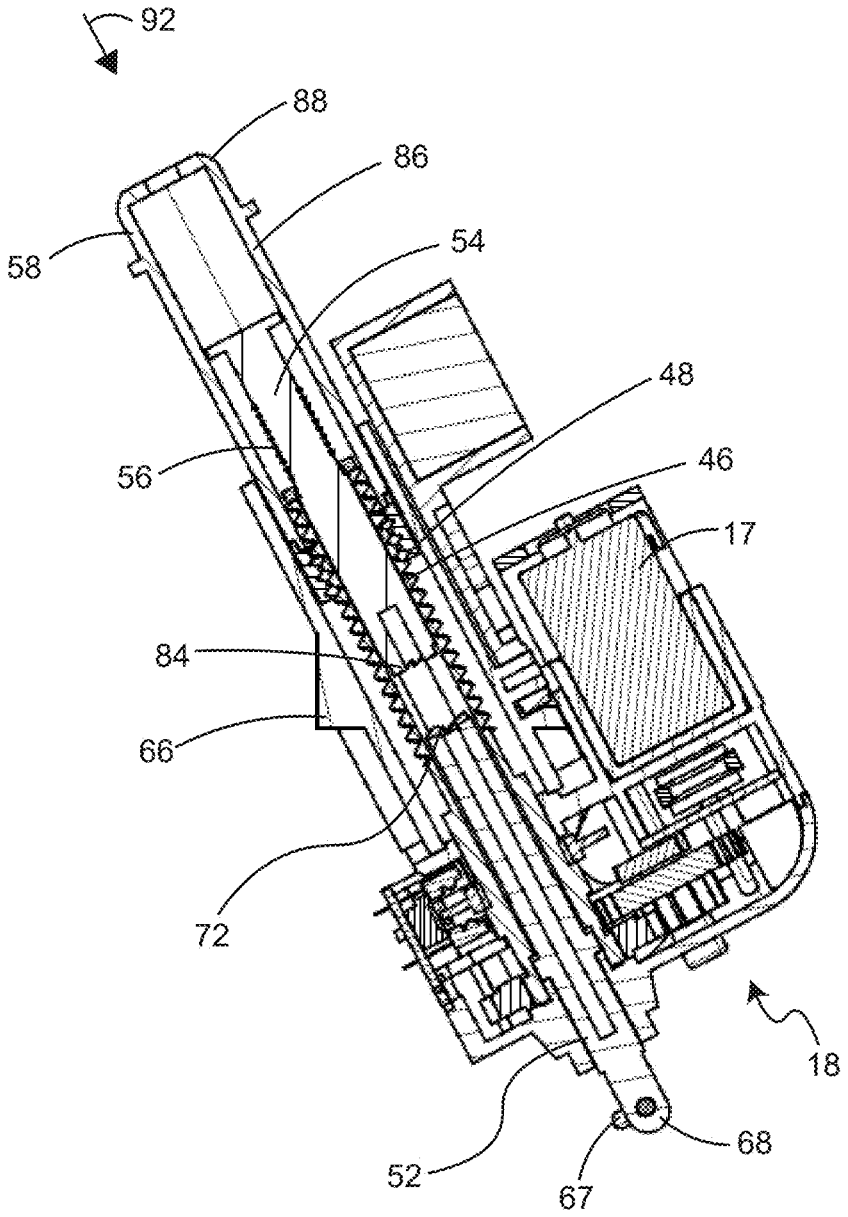
FIG. 10 is a sectional side view of the drive train from the inner object shown in FIG. 2, illustrating the carriage in an extended position.

Rotation of the leadscrew 46 in a second leadscrew direction (e.g. clockwise in the view shown in FIG. 8) drives the leadscrew nut 48 in a second nut direction (shown at 92 in FIG. 10), which in turn drives the carriage 58 towards the plunger 54, driving the plunger 54 to the shaft engagement position (FIG. 7), ultimately driving the plunger 54 to a second function position in which the plunger 54 is operatively connected to the rotary function shaft 52, so as to drive rotation of the planet gear 50 so as to rotate the inner object 14 from the first rotational position 76 to the second rotational position in the housing 78.

Driving movement of the breakout member 16 to engage the housing 12 to break the housing 12 may be but an example of a first function that is performed by the carriage 58. Alternatively, any other suitable first function may be performed by the carriage 58. Thus, the breakout member 16 may, more broadly be referred to as a first functional element 16, that is movable linearly between a retracted position and an extended position to carry out a first function. While in the presently shown embodiment movement of the first functional element 16 to the extended position carries out the first function, it is alternatively possible for the movement of the first functional element 16 to the retracted position to carry out the first function, depending on what the first function is desired to be.

Driving rotation of the planet gear 50 so as to rotate the inner object 14 from the first rotational position 76 to the second rotational position in the housing 78 may be but an example of a second function that is performed by the carriage 58. Alternatively, any other suitable second function may be performed by the carriage 58. Thus, the planet gear 50 may, more broadly be referred to as a second functional element 50, that is rotatable from a first rotary position to a second rotary position.

Thus it may be said that the inner object 14 includes a first functional element (e.g. the breakout member 16) that is movable linearly between a retracted position and an extended position to carry out a first function while the inner object 14 is in the housing 12 (e.g. breaking the housing 12), and the inner object 14 includes a second functional element (e.g. the planet gear 50) that is rotatable and is movable via rotation from a first rotary position to a second rotary position to carry out a second function while the inner object 14 is in the housing 12 (e.g. to rotate the inner object 14 from a first rotational position to a second rotational position in the housing 12, in order for the inner object 14 to then carry out the first function again to break the housing 12 in a new location).

While it has been shown for the second function element to be the planet gear 50 it will be understood that the second functional element may be any type of gear, or may, more broadly, be any rotary element.

The motor 17 has been shown to be operatively connected to the leadscrew 46 by the drive train 18 and a particular example of the drive train 18 has been shown and described above. It will be noted that any other suitable way of operatively connecting the motor 17 to the leadscrew 46 may be provided. For example, the drive train 18 could in some embodiments be entirely made up of gears between the motor 17 and the leadscrew 46. Alternatively, the motor 17 may include internal speed reduction that reduces the speed of the motor output shaft 30 such that a simple coupling may connect the motor output shaft 30 to the leadscrew 46, or a single gear on the motor output shaft 30 may directly engage corresponding gear teeth on the leadscrew 46.

It will be noted that the leadscrew 46, the leadscrew nut 48, the rotary function shaft 52, the plunger 54, the plunger biasing member 56, and the carriage 58 permit the motor 17 to drive first and second functions, one that is a linear movement and one that is a rotary movement, without the need for a second motor, or separate actuators. This is advantageous in that it reduces the cost of manufacture of the inner object 14 and of the toy assembly 10 overall. Furthermore, the leadscrew 46, the leadscrew nut 48, the rotary function shaft 52, the plunger 54, the plunger biasing member 56, and the carriage 58 are all concentric about a common axis (i.e. the aforementioned leadscrew axis AL), which results in a compact arrangement for achieving the aforementioned first and second functions. More specifically, there are at least three layers of concentricity present in these aforementioned elements. In the example shown in FIG. 7, the three layers of concentricity appear in several places. For example, the carriage 58 surrounds the plunger biasing member 56, which surrounds the plunger 54. Separately, the carriage 58 surrounds the leadscrew 46, which surrounds the plunger 54. Separately again, the leadscrew nut 46, surrounds the leadscrew 46, which surrounds the rotary function shaft 52. More generally described, the motor 16 is operatively connected to a first functional element (e.g. the breakout member 16) and to a second functional element (e.g. the planet gear 50), via a set of elements including the leadscrew 46, the leadscrew nut 48, the rotary function shaft 52, the plunger 54, the plunger biasing member 56, and the carriage 58, and the leadscrew 46 is itself surrounded by at least a first one element from the set of elements, and surrounds at least a second one element from the set of elements.

The drive train 18 that has been described is advantageous from a noise and cost perspective. More specifically, the motor 17 may advantageously operate at a high speed, such as, for example, between 11500 rpm and 12500 rpm, or more particularly, such as about 12000 rpm. However, it has been found that transmitting power at this rpm via gears, such as polymeric gears, generates excessive noise. To mitigate the noise, the drive train 18 includes the drive pulley 32, the driven pulley 34 and the belt 36, which extends between the drive pulley 32 and the driven pulley 34. The drive pulley 32 and the driven pulley 34 have a size ratio such that the driven pulley 34 rotates at a driven pulley speed that is less than 4000 rpm. It has been found that, once the rotational speed drops below about 4000 rpm, gears may be used to transmit power. Thus, in the plurality of gears that make up the gear train, the plurality of gears all rotate at speeds that are less then 4000 rpm. For greater certainly, while the motor output shaft 30 may rotate at about 12000 rpm in some embodiment, the motor 17 may be a motor that rotates at some other rpm that is greater than 4000 rpm and in such a case, the drive pulley 32, and the driven pulley 34 may be sized to have a speed reduction to bring the speed down below 4000 rpm. In still other embodiments, the motor output shaft 30 may rotate at a speed that is less than 4000 rpm and the drive train 18 may include a first gear that is mounted on the motor output shaft 30, since the noise level may be sufficiently low that the drive pulley 32, the driven pulley 34 and the belt 36 are not needed for the purposes of noise reduction. In still other embodiments, the motor output shaft 30 may rotate at a speed that is greater than 4000 rpm the drive train 18 may include a first gear that is mounted on the motor output shaft 30, in an application in which it is not desired to bring the noise level down below a selected level. Alternatively, the drive train 18 may include any other power transmission elements instead of, or in addition to, gears and/or pulleys and one or more belts.

Figure 17:
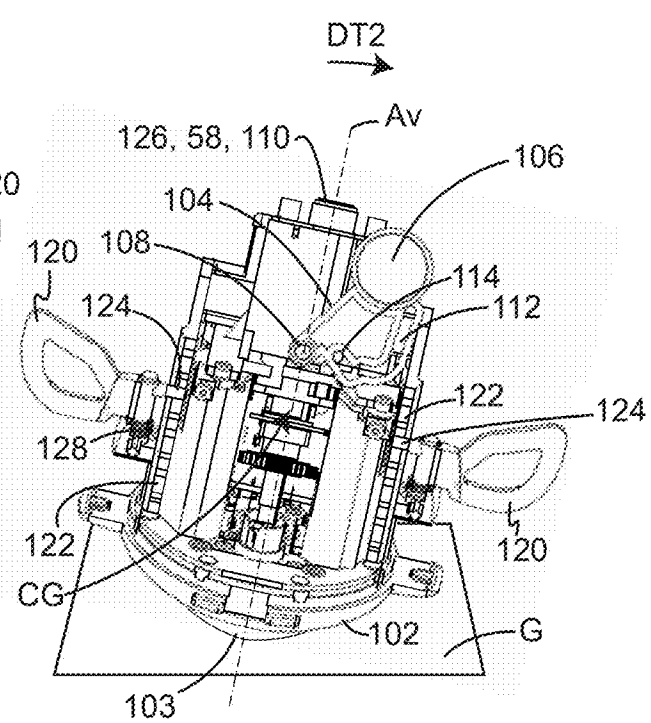
FIG. 17 is a perspective view of the interior of the inner object shown in FIG. 2, showing the weighted arm with the weight in a third position.
Figure 16:
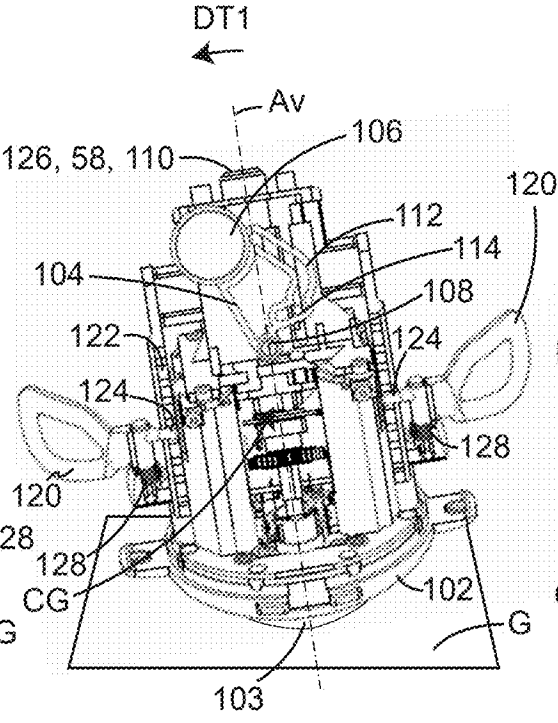
FIG. 16 is a perspective view of the interior of the inner object shown in FIG. 2, showing the weighted arm with the weight in a second position.
Figure 15:
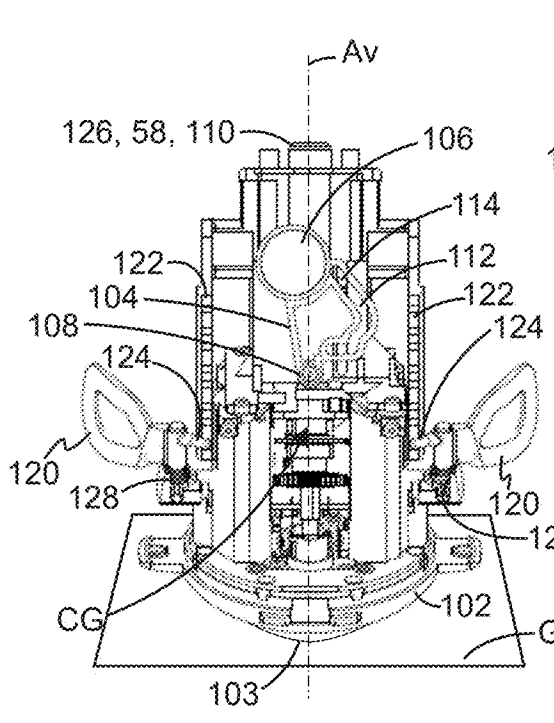
FIG. 15 is a perspective view of the interior of the inner object shown in FIG. 2, showing a weighted arm with a weight in a first position.

Reference is made to FIGS. 15-17, which show a weighted arm 104 that has a weight 106 thereon, that is used to cause tipping of the inner object 14. In some embodiments, in which the inner object 14 is a toy character 14, the tipping of the inner object 14 may be carried out in order to provide a lifelike animation to the toy character 14.

Figure 5:
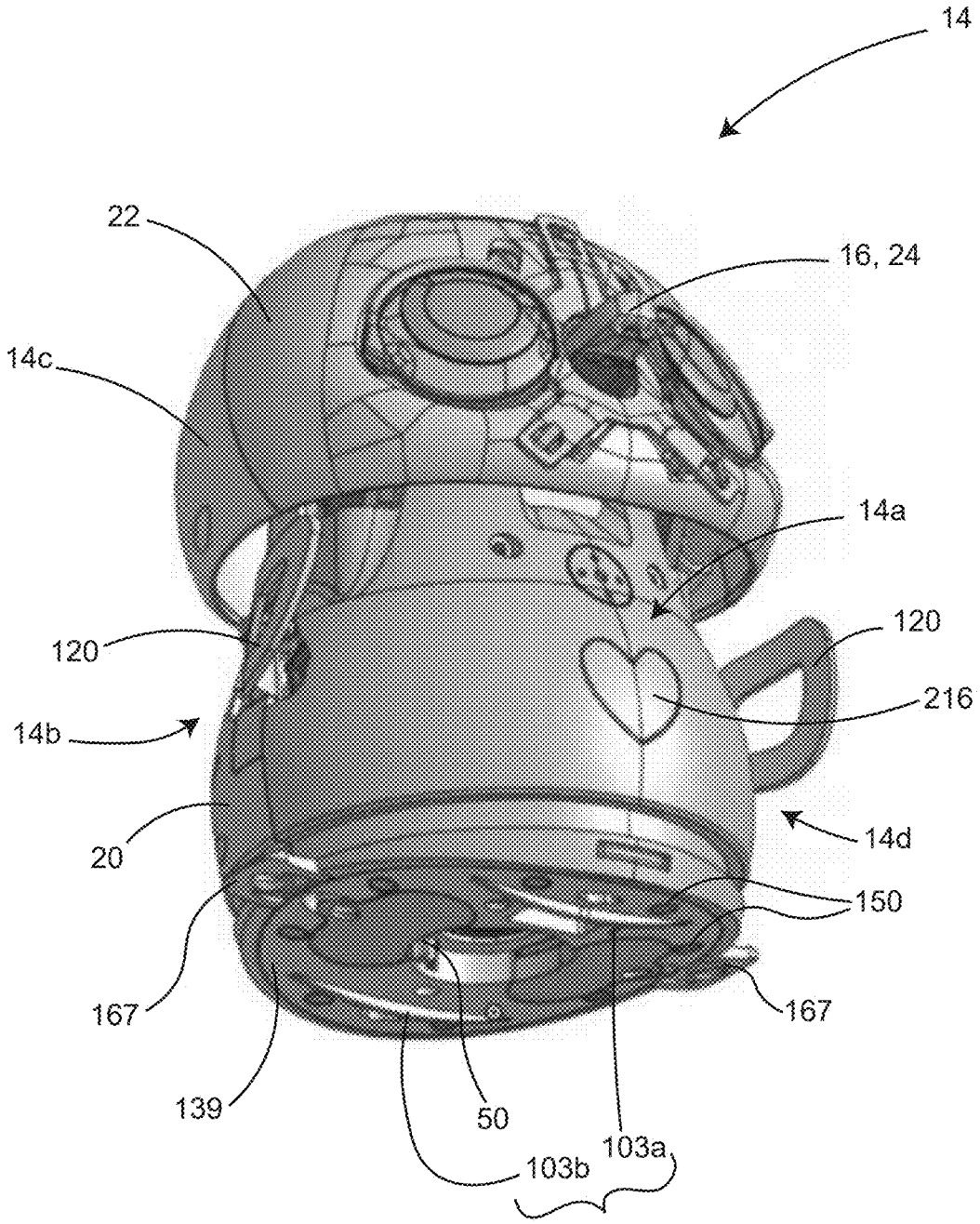
FIG. 5 is a perspective view of the inner object shown in FIG. 2.

The inner object 14 includes a housing 102, that may also be referred to as the inner object housing 102, or the toy character housing 102 in embodiments in which the inner object 14 is a toy character 14. The toy character housing 102 defines a vertical axis Av as shown in FIG. 15. The toy character housing 102 includes a ground engagement surface 103 supports the toy character 14 on a support surface G, but that permits tipping of the toy character 14. In the embodiment shown the ground engagement surface 103 is arcuate in a vertical plane. In the present embodiment, the toy character 14 has a front 14*a* and a rear 14*b* as shown in FIG. 5, and has a first lateral side 14*c* and a second lateral side 14*d*, and the vertical plane extends laterally. In other embodiments, the vertical plane could extend in other directions than laterally, such as, for example, sagittally. In the embodiment shown, the ground engagement surface 103 includes a first ground engagement surface portion 103*a* and a second ground engagement surface portion 103*b*, which are spaced sagittally from one another on the toy character 14. However, it is alternatively possible for the ground engagement surface 103 to be made up of only one portion that is contiguous. In the embodiment shown, the ground engagement surface 103 is an arcuate surface. However, it is alternatively possible for the ground engagement surface 103 to be made up of a plurality of straight segments that are not themselves arcuate but which together approximate an arcuate shape. Any other suitable shape for the ground engagement surface 103 may be provided, that permits tipping of the toy character 14, in embodiments in which the toy character 14 is intended to tip. In still other embodiments, the ground engagement surface 103 need not permit tipping of the toy character 14, but instead may be shaped to hold the toy character 14 stably on the ground or other support surface (shown at G in FIGS. 15-17).

The toy character 14 further includes a weighted arm 104 with a weight 106 thereon. The weighted arm 104 is movable to change a distance of the weight 106 to the vertical axis Av. In the embodiment shown, the weighted arm 104 is pivotable in its movement to change the distance of the weight 106 to the vertical axis Av, by means of a pivot connection 108 to the toy character housing 102. However, the weighted arm 104 may be movable by any other suitable means, such as by means of a sliding connection to the toy character housing 102.

The toy character 14 further includes a weighted arm driver 110 that drives movement of the weighted arm 104. In the embodiment shown, the weighted arm driver 110 is the carriage 58, and is thus driven by the motor 17. However the weighted arm driver 110 could alternatively be a separate element from the carriage 58, and could be driven by the motor 17, or could be driven by another member such as a separate motor.

Figure 18:
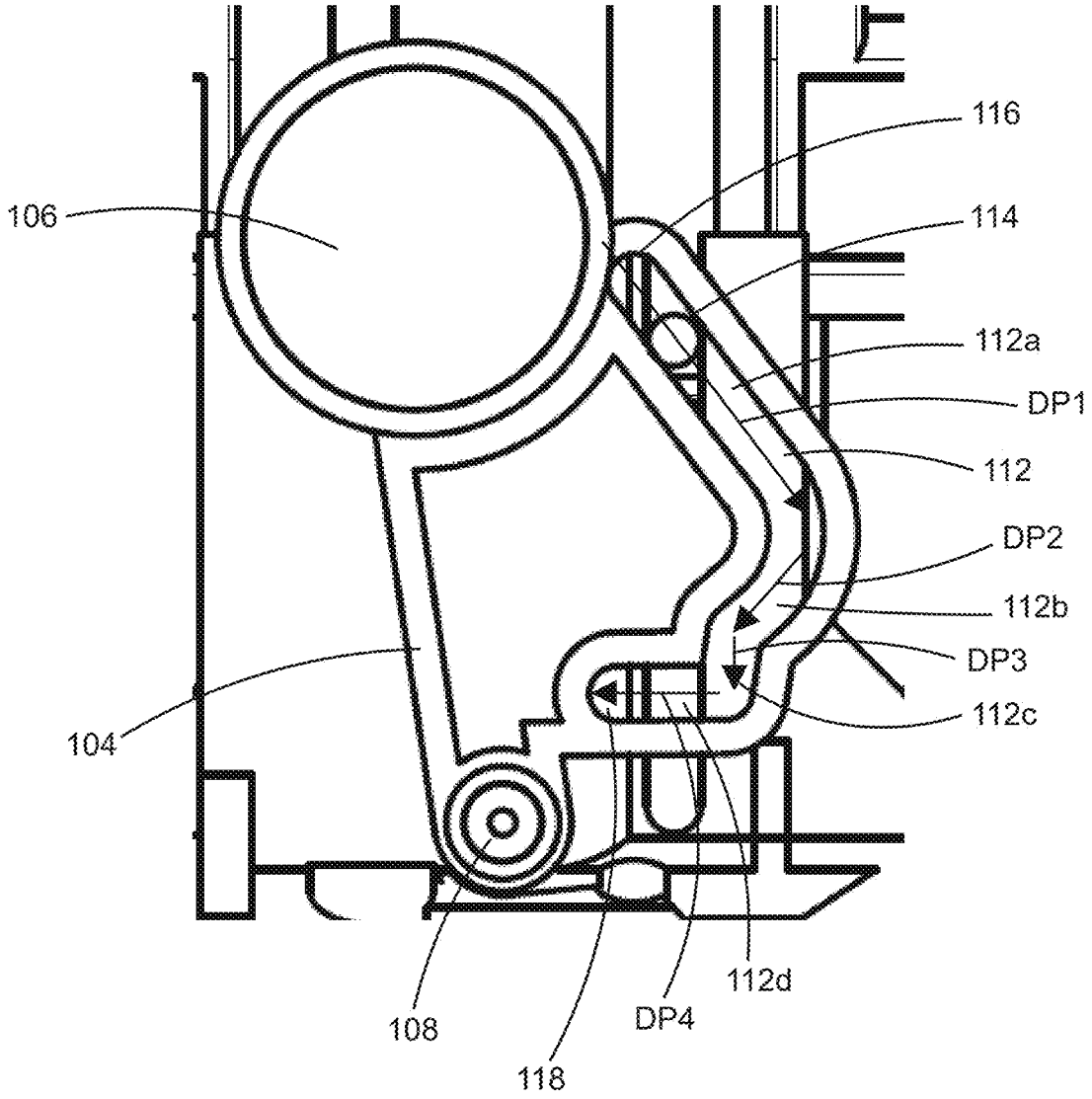
FIG. 18 is a magnified plan view of the weighted arm with the weight.

The toy character 14 further includes a weighted arm cam path 112, and a weighted arm cam path engagement member 114. One of the weighted arm cam path 112 and the weighted arm cam path engagement member 114 is connected to the weighted arm 104, and the other of the weighted arm cam path 112 and the weighted arm cam path engagement member 114 is connected to the weighted arm driver 110. In the embodiment shown in FIGS. 15-17, the weighted arm cam path 112 is connected to the weighted arm 104, and the weighted arm cam path engagement member 114 is connected to the weighted arm driver 110. However, it is alternatively possible for the weighted arm cam path 112 to be connected to the weighted arm driver 110, and the weighted arm cam path engagement member 114 to be connected to the weighted arm 104. The motor 17 is operatively connected to the weighted arm driver 110, such that rotation of the motor 17 by a first amount in a first direction drives movement of the weighted arm driver 110, which in turn drives movement of the weighted arm cam path engagement member 114 along a first portion of the weighted arm cam path 112, so as to move the weighted arm 104 and the weight 106 so as to move a center of gravity (also referred to as CG) for the toy character 14 to a first position that causes tipping of the toy character 14 in a first tipping direction DT1 (shown in FIG. 16). The weighted arm cam path 112 is shaped such that continued rotation of the motor 17 by a second amount beyond the first amount in the first direction drives movement of the weighted arm driver 110, which in turn drives movement of the weighted arm cam path engagement member 114 along a second portion of the weighted arm cam path 112, so as to move the weighted arm 104 and the weight 106 so as to move the CG for the toy character 14 to a second position that causes tipping of the toy character 14 in a second tipping direction DT2. The specific routing of the weighted arm cam path 112 may be selected based on a routing of a path of movement of the weighted arm cam path engagement member 114. In the embodiment shown, the weighted arm cam path 112 has a generally zigzag routing, while the weighted arm cam path engagement member 114 travels along a straight path as can be seen in FIGS. 15-17. The zigzag routing of the weighted arm cam path 112 is shown more clearly in FIG. 18, and includes a first path segment 112*a*, which extends in a first direction DP1, a second path segment 112*b* that extends in a second direction DP2, a third path segment 112*c* that extends in a third direction DP3, and a fourth path segment 112*d* that extends in a fourth direction DP4. The second direction DP2 is to the right of the first direction DP1 (as viewed from the perspective of an object travelling along the weighted arm cam path 112). The third direction DP3 is to the left of the second direction DP2. The fourth direction DP4 is to the right of the three direction DP3. More broadly worded, the second direction DP2 is to a first side of the first direction DP1; the third direction DP3 is to a second side of the second direction DP2; and the fourth direction DP4 is to the first side of the third direction DP3, where the first side is the left side and the second side is the right side. It is alternatively possible for the first side to be the right side and for the second side to be the left side.

It will be noted that any particular adjacent path segments of the weighted arm cam path 112 may be considered to be the first portion and the second portion of the weighted arm cam path 112, depending on what point is considered to be the starting point of the weighted arm cam path engagement member 114 on the weighted arm cam path 112. If a starting point for the weighted arm cam path engagement member 114 is at a first end 116 of the weighted arm cam path 112, the first, second, third and fourth path segments 112*a*, 112*b*, 112*c* and 112*d* constitute first, second, third and fourth portions of the weighted arm cam path 112, respectively. If the starting point for the weighted arm cam path engagement member 114 is at a second end 118 of the weighted arm cam path 112, the fourth, third, second, and first path segments 112*a*, 112*b*, 112*c* and 112*d* constitute the first, second, third and fourth portions of the weighted arm cam path 112, respectively.

Furthermore, the first direction for the motor 17 may be a direction to drive the carriage 58 towards the retracted position (i.e. away from the position shown in FIG. 15 and towards the position shown in FIG. 17). It is alternatively possible however, for the first direction for the motor 17 to be a direction to drive the carriage 58 towards the extended position (i.e. away from the position shown in FIG. 17 and towards the position shown in FIG. 15).

In the embodiment shown, the weighted arm 104 is movable to change the distance of the weight 106 laterally relative to the vertical axis Av. Furthermore, the first tipping direction is a first lateral direction and the second tipping direction is a second lateral direction. In other words, as noted above, in the embodiment shown the ground engagement surface 103 is arcuate in the vertical plane, which extends laterally. However, the first and second tipping directions may be directions that are other than lateral directions, such as sagittal directions and the weighted arm 104 may be movable to change the distance of the weight 106 in some other direction (e.g. sagittally) relative to the vertical axis Av.

Figure 12:
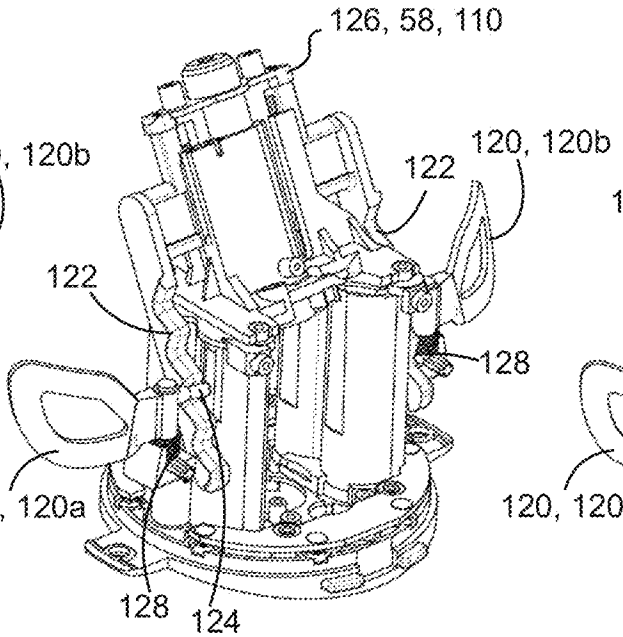
FIG. 12 is a perspective view of the interior of the inner object shown in FIG. 2, showing the drive train in the position shown in FIG. 9, with the carriage in the intermediate position.
Figure 11:
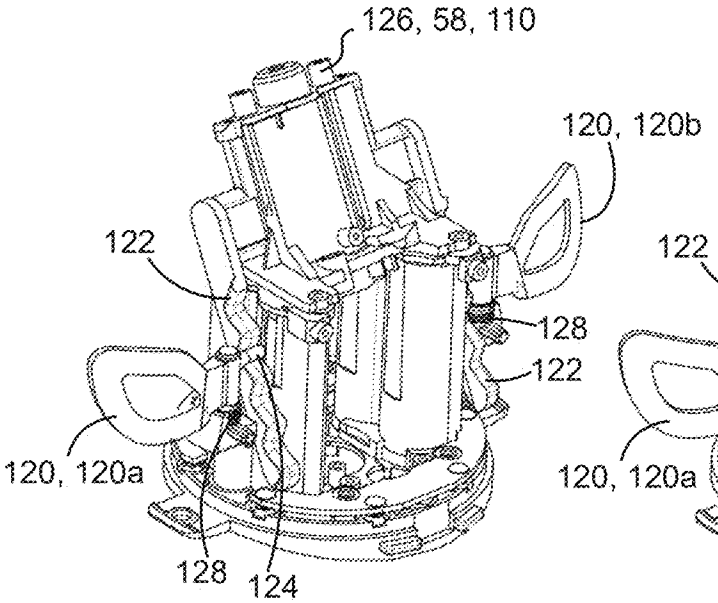
FIG. 11 is a perspective view of the interior of the inner object shown in FIG. 2, showing the drive train in the position shown in FIG. 7, with the carriage in the retracted position.

Reference is made to FIGS. 11-13. The inner object 14, particularly in embodiments in which it is a toy character 14, may include an appendage 120, which may be a first appendage 120 of a plurality of appendages 120. The appendage 120 is, in the present embodiment, a wing, but it could alternatively be any other suitable type of appendage, such as an arm, a leg, or an antenna (each of which is representative of an appendage on a living organism), or an appendage that does not represent an appendage on a living organism.

The inner object 14 further includes an appendage cam path 122, an appendage cam path engagement member 124, and an appendage driver 126. The appendage cam path 122 may be on one of the appendage 120 and the appendage driver 126 and appendage cam path engagement member 124 may be on the other of the appendage 120 and the appendage driver 126. In the present embodiment, the appendage cam path 122 is connected to the appendage driver 126 and the appendage cam path engagement member 124 is connected to the appendage 120.

The appendage driver 126 may be the carriage 58. Alternatively, the appendage driver 126 may be a separate element that is separately driven by the motor 17, or optionally, by a separate motor.

Movement of the carriage 58 between the extended and retracted positions, correspond to movement of the appendage driver 126 between a first position (e.g. as shown in FIG. 11) and a second position (e.g. as shown in FIG. 13).

The inner object 14 further includes an optional appendage cam arrangement biasing member 128 that is positioned to urge the appendage cam path 122 and the appendage cam path engagement member 124 into engagement with one another. In the present embodiment, the appendage 120 is pivotally connected to the inner object housing 102 and the appendage cam arrangement biasing member 128 is a torsion spring that is positioned to urge the appendage cam path engagement member 124 into engagement with the appendage cam path 122.

As the appendage driver 126 moves between the first and second positions, the appendage cam path 122 moves past the appendage cam path engagement member 124, while the appendage cam arrangement biasing member 128 maintains contact between the appendage cam path engagement member 124 and the appendage cam path 122. The appendage cam path 122 is shaped to generate movement of the appendage 120. In the example shown in FIGS. 11-13 the movement is a reciprocating flapping movement of the appendage 12. In the example shown in FIGS. 11-13, there are two appendages 120 (i.e. a first appendage 120*a* and a second appendage 120*b*), and their movement is synchronized in the sense that they both flap rearwardly at the same time and they both flap forwardly at the same time, however it is alternatively possible for the appendage cam path 122 for the first appendage 120*a* to be positioned differently, or even to have an entirely different routing than the appendage cam path 122 for the second appendage 120*b*.

Figure 19:
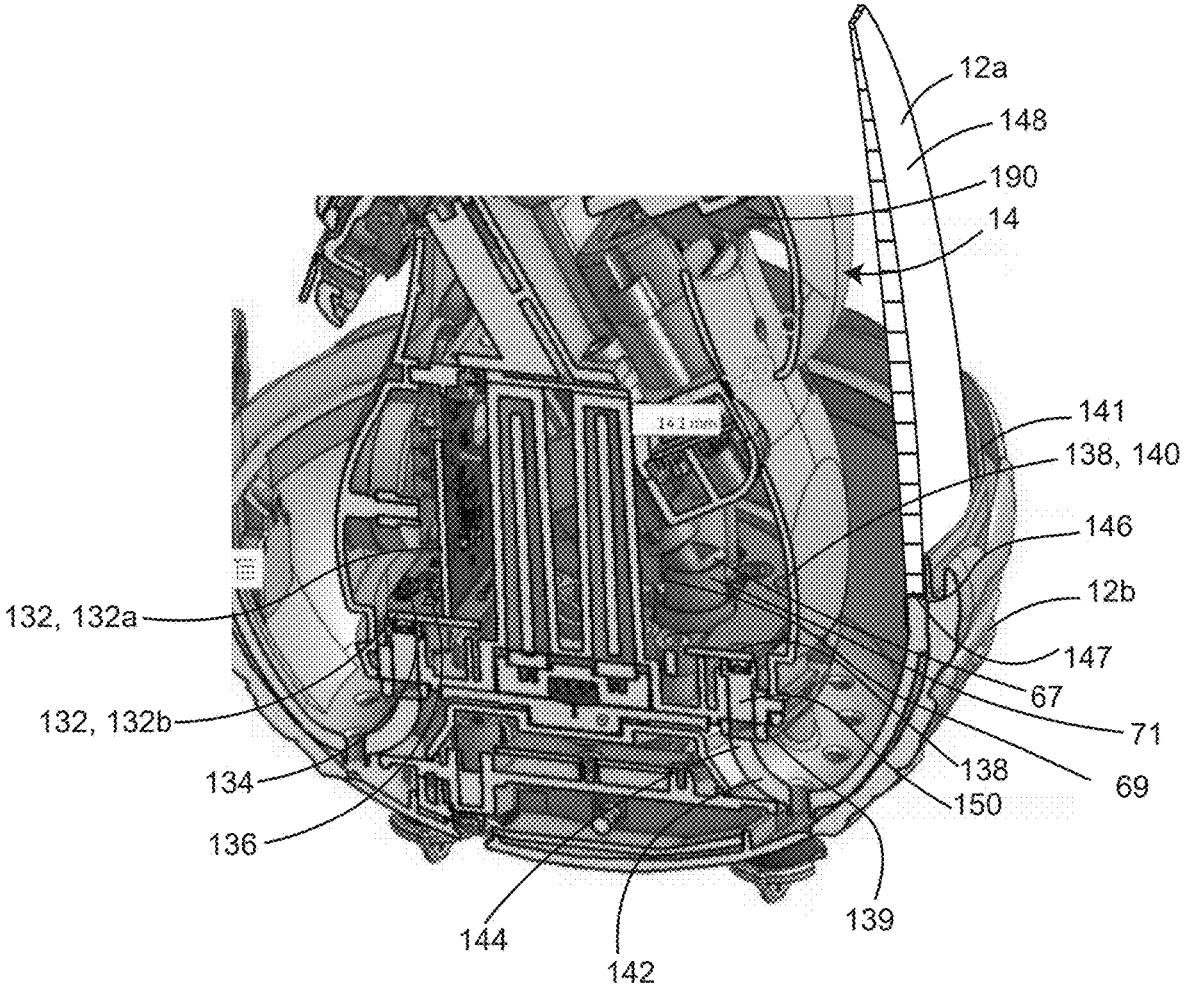
FIG. 19 is a sectional perspective view of a portion of the housing and the inner object, showing light emitting elements and a light transfer member.

Reference is made to FIG. 19. The toy assembly 10 includes a control system 130. The control system 130 may include a printed circuit board 132 (also referred to as a PCB 132), a processor 134 and a memory 136 connected to the processor 134. In the embodiment shown, the PCB 132 is a first PCB 132 (shown at 132*a*) and the toy assembly 10 further includes a second PCB 132, shown individually at 132*b*. In the embodiment shown, the memory 136 and the processor 134 are both mounted to one of the PCBs 132 and are connected to one another via a plurality of electrical traces on the PCB 132 to which they are mounted.

The control system 130 is used to control the operation of, among other things, the motor 17, in embodiments in which the motor 17 is an electric motor. In order to determine the position of the carriage 58 and to stop operation of the motor 17 once the carriage 58 reaches a selected position, the inner object 14 may further include an encoder (shown at 137 in FIG. 7) that sends signals to the control system 130 that are indicative of a position of the carriage 58. The processor 134 may be programmed to control operation of the motor 17 based on the signals from the encoder 137. The encoder 137 may be any suitable type of encoder, such as an optical encoder, which employs a rotary disc 137*a* with apertures spaced about its circumference, a encoder light emitting element 137*b* positioned on one side of the rotary disc and a light sensor 137*c* positioned on the other side of the rotary disc, for detecting light from the encoder light emitting element through the apertures. Alternatively, the encoder 137 may employ any other technology for determining the position of the carriage 58, such as, for example, a Hall-effect sensor, and regularly spaced features on the rotary disc that would cause perturbations in a magnetic field being sensed by the Hall-effect sensor.

The toy assembly 10 further includes at least one light emitting element 138 that is positioned on the inner object 14 and which is not visible from the exterior of the housing 12. The inner object 14 may be said to include the at least one light emitting element 138. In the embodiment shown, the at least one light emitting element 138 is positioned on an underside of the PCB 132, and is recessed from a bottom (shown at 139) of the inner object housing 102. Since the second housing member 12*b* is opaque and since a top edge (shown at 141) of the second housing member 12*b* is higher than the bottom 139 of the inner object housing 102, there is no sightline from a user outside the housing 12 to the at least one light emitting element 138.

The at least one light emitting element 138 may be at least one light emitting diode 140 (also referred to as at least one LED 140), or may alternatively be any other suitable type of light emitting element.

Figure 4:
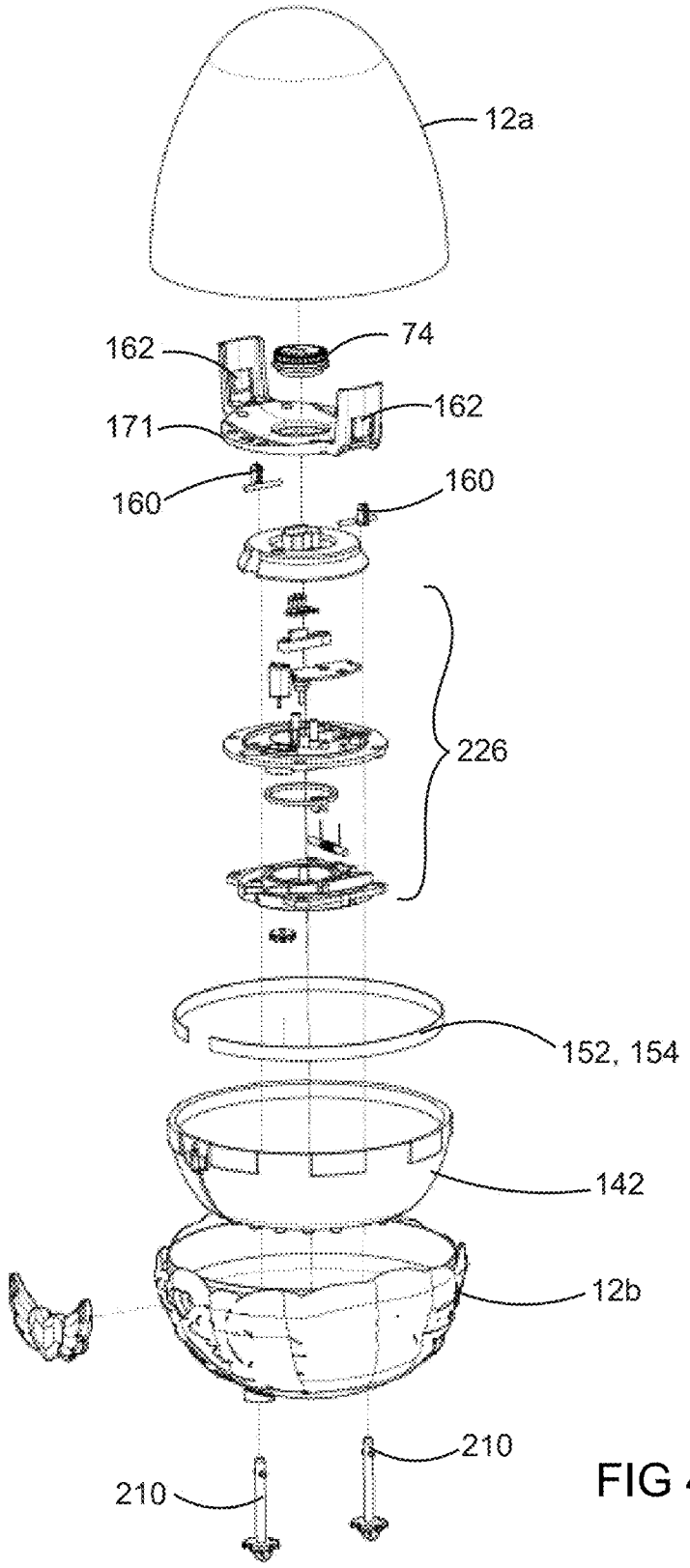
FIG. 4 is a perspective view of the housing from the toy assembly shown in FIG. 1, more fully exploded.

The housing 12 includes a light transfer member 142 shown in FIGS. 4 and 19. The light transfer member 142 has a light inlet 144 and a light outlet 146.

The light outlet 146 is positioned to direct light into the first housing member 12*a* so as to render the light visible from the exterior of the housing 12, in embodiments in which the first housing member 12*a* is light transmissive. In the embodiment shown, the light outlet 146 of the light transfer member 142 is positioned facing a light inlet 147 of the first housing member 12*a*, as shown in FIG. 19. The light transmitted through the first housing member 12*a* is at least partly visible through the outer surface of the first housing member 12*a* (shown at 148). Thus the outer surface 148 of the first housing member 12*a* may be considered to be a light outlet for the first housing member 12*a*.

The at least one light emitting element 138 is positioned to direct light at the light inlet 144 of the light transfer member 142 so as to transmit the light through the light transfer member 142 into the first housing member 12*a* and through the outer surface of the first housing member 12*a* so as to be visible from the exterior of the housing 12.

Based on the above, it may be said that the at least one light emitting element 138 is operable by the control system 130 (e.g. by the processor 134) to emit light. The light inlet 144 of the light transfer member 142 is positioned to receive the light emitted by the at least one light emitting element 138. The light transfer member 142 is shaped to transmit the light from the light inlet 144 to the light outlet 146. The light outlet 146 is positioned to transmit the light to the light inlet 147 of the first housing member 12*a*. The first housing member 12*a* is positioned to transmit the light through the outer surface 148 thereof, such that the light is visible from the exterior of the housing 12. Alternatively, it may be said that the first housing member 12*a* is positioned to transmit the light through the light outlet thereof, such that the light is visible from the exterior of the housing 12, as this wording is also applicable to embodiments in which the light outlet of the first housing member 12*a* is not simply the outer surface 148 of the first housing member 12*a*, but is instead some other surface that is visible from the exterior of the first housing member 12*a*.

The light transfer member 142 may be arcuate (as shown in FIGS. 4 and 19) between the light inlet 144 and the light outlet 146, such that the light inlet 144 is oriented to direct the light in a first direction into the light transfer member and the light outlet 146 is oriented to direct the light in a second direction that is different than the first direction. In the embodiment shown, the light inlet 144 is oriented to direct the light downwards and the light outlet 146 is oriented to direct the light upwards.

Figure 20:
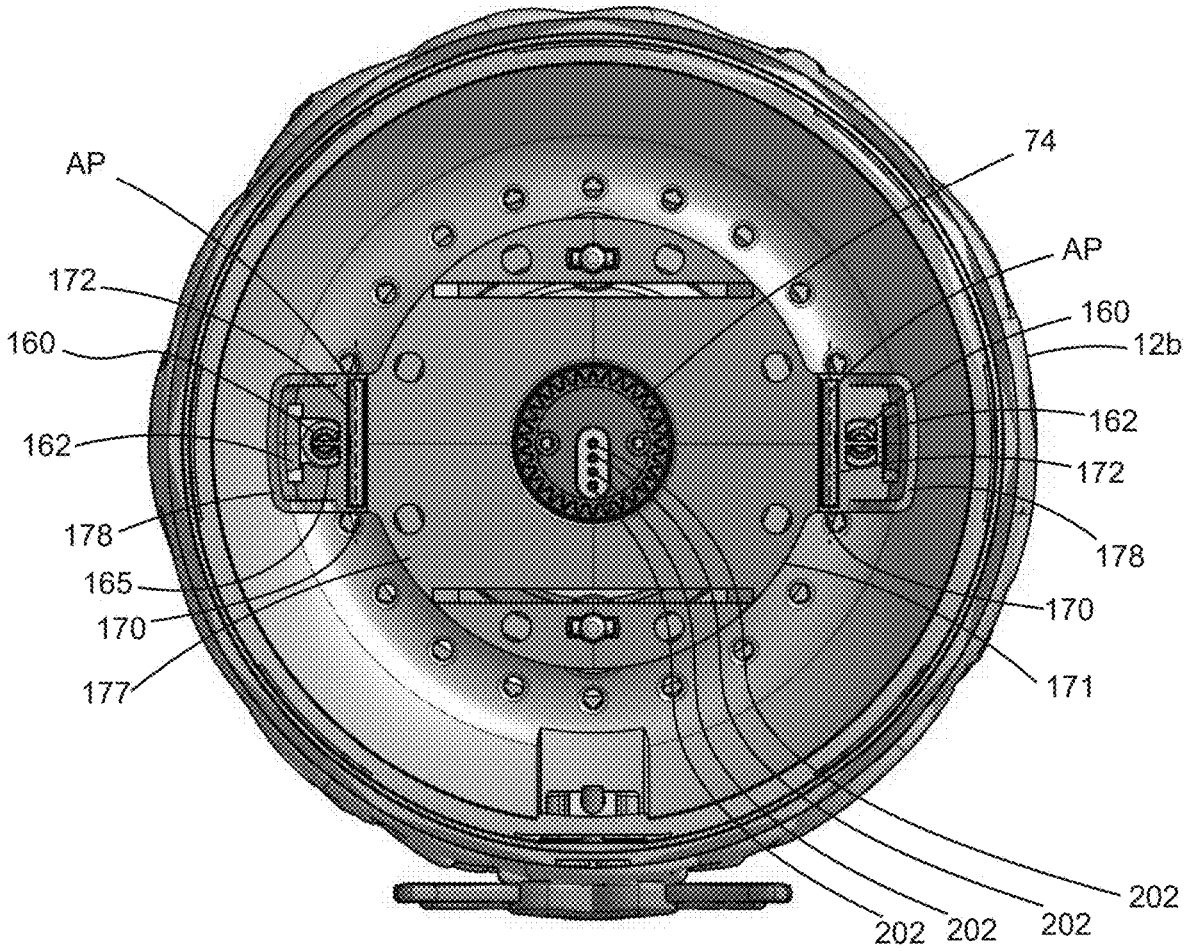
FIG. 20 is a plan view of a lower portion of the housing from the toy assembly shown in FIG. 1.

The light transfer member 142 is made from a light transfer material with a selected index of refraction and which is shaped to transmit light therethrough from the light inlet 144 to the light outlet 146 using total internal reflection. As can be seen in FIG. 20, the light inlet 144 of the light transfer member 142 has a first surface area A1 and the light outlet 146 of the light transfer member 142 has a second surface area A2 that is larger than the first surface area A1. The light transfer member 142 may be shaped to permit the light to diverge between the light inlet 144 and the light outlet 146.

Optionally, with reference to FIG. 19, the inner object 14 further includes a protection element 150 that collects the light from the at least one light emitting element 138 and transmits it to the bottom 139 of the inner object 14, towards the light inlet 144 of the light transfer member 142. The protection element 150 may be made from a similar material as the light transfer member 142, and may be provided to protect the at least one light emitting element 138 from inadvertent damage during play by a user with the inner object 14.

In the embodiment shown, the inner object 14 includes a plurality of light emitting elements 138. There are eight light emitting elements 138 provided, however, it is alternatively possible for there to be fewer or more light emitting elements 138 provided.

The toy assembly 10 may further include at least one sensor 152. The at least one sensor 152 may include a housing sensor 153 that detects interaction by a user with the housing 12. For example, the housing sensor 154 may be a capacitive sensor shown in FIG. 2 that is mounted to the housing 12, or may be any other suitable type of sensor. One or more other housing sensors 153 may additionally be provided.

Figure 6:
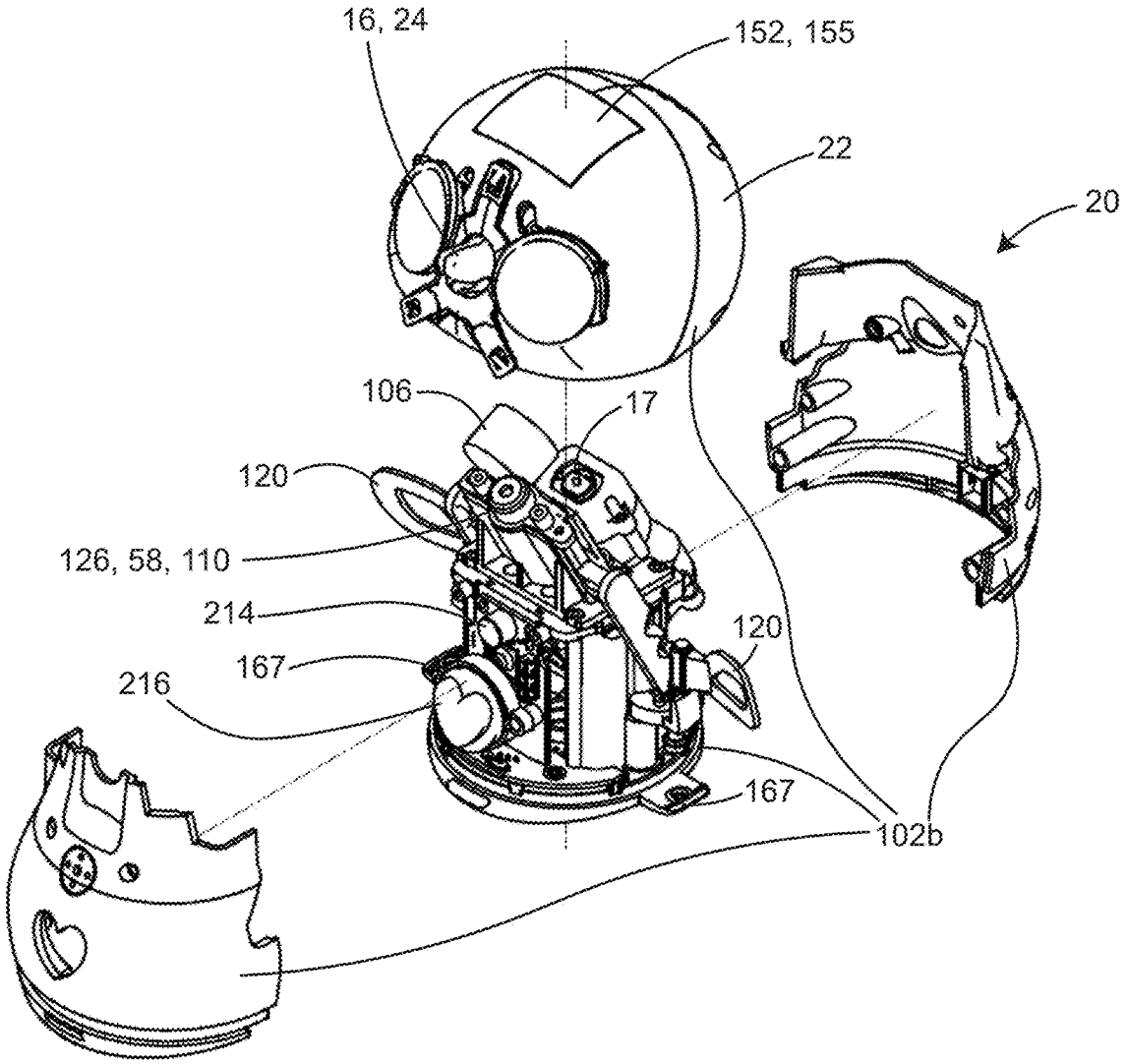
FIG. 6 is a perspective view of the inner object shown in FIG. 2, partially exploded.

As shown in FIGS. 2 and 6, the at least one sensor 152 may include an inner object sensor 155, which may be any suitable type of sensor, such as, for example, a contact sensor on the head 22 of the inner object 14. The inner object sensor 155 may be used when the user is interacting with the inner object 14 directly. The processor 134 may be determine if a selected condition has been met based on the interaction of the user with the inner object 14 (e.g. with the inner object sensor 155) and may be programmed to activate at least one of: a light emitting element on the inner object 14 (such as the at least one light emitting element 138 or any other light emitting element), a motor (such as the motor 17, or any other motor), a speaker that is electrically connected to the PCB 132, (wherein a portion of the speaker is shown at 190 in FIG. 19 or any other suitable example of an output device that is included with the inner object 14. The speaker 190 may be positioned anywhere suitable, such as at the back of the head 22 of the inner object 14.

In another example, the PCB 142 may have thereon an accelerometer and/or an orientation sensor, which sends signals to the processor 134 that are indicative of how the user is manipulating or holding the inner object 14 (and therefore how the user is manipulating or holding the toy assembly 10 when the inner object 14 is still inside the housing 12. Thus, the accelerometer and/or the orientation sensor may be considered to be both an inner object sensor 155 and a housing sensor 152.

The processor 134 may be programmed to execute instructions stored in the memory 136, to determine whether a selected condition has been met based on signals from the at least one sensor 152, and to operate the at least one light emitting element 138 if the condition is met. For example, if the processor 134 detects that the user has engaged the housing sensor 154 for more than five seconds, the processor 134 may be programmed to operate the at least one light emitting element 138, thereby lighting up the first housing member 12*a*. The selected condition may alternatively be any other selected condition. For example, the processor 134 may be programmed to execute instructions stored in the memory 136, to determine whether the user has tapped the housing 12 at least 10 times.

Figure 28:
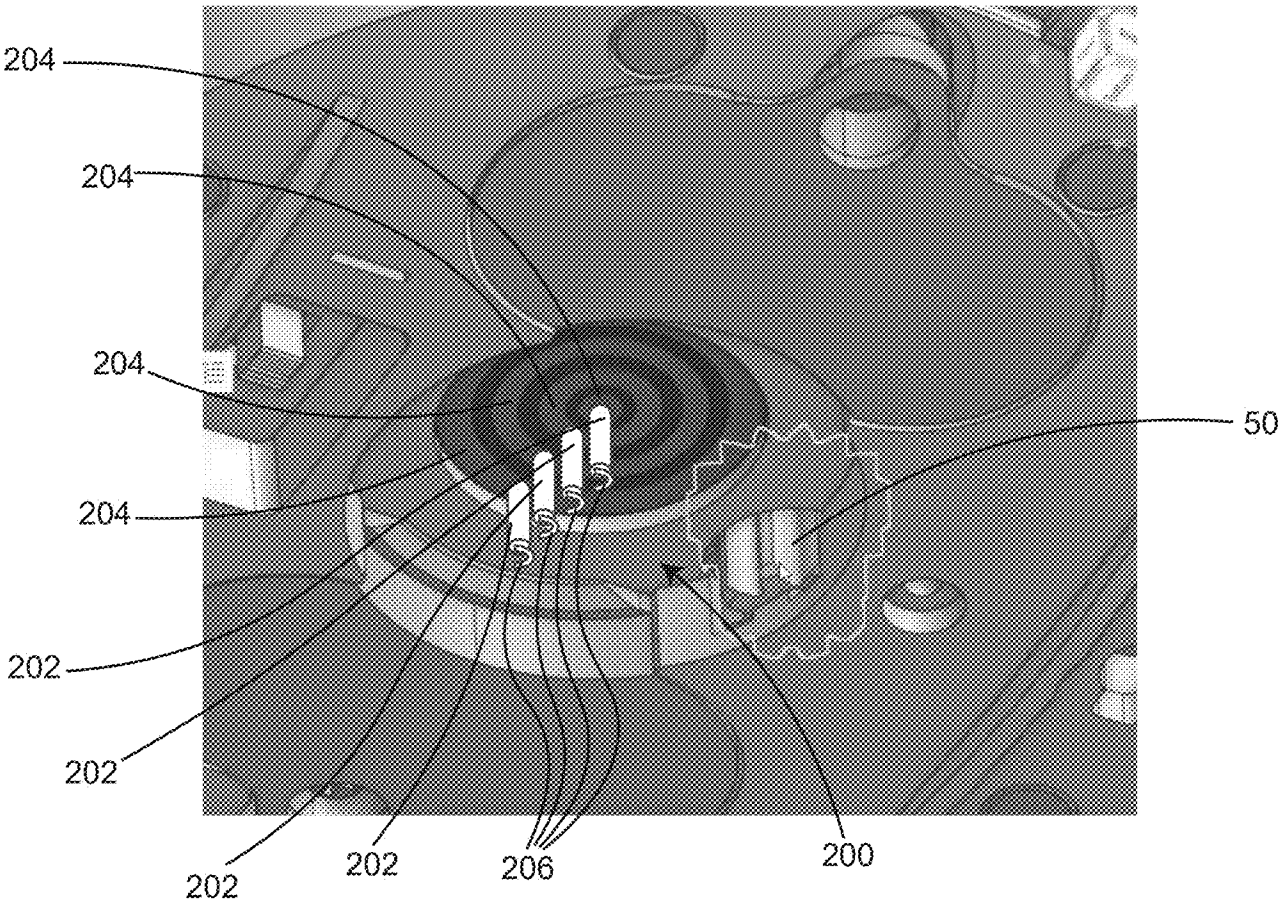
FIG. 28 is a magnified perspective view of an underside of the inner object, showing inner object contacts that are in electrical communication with housing contacts from the housing.
Figure 29:
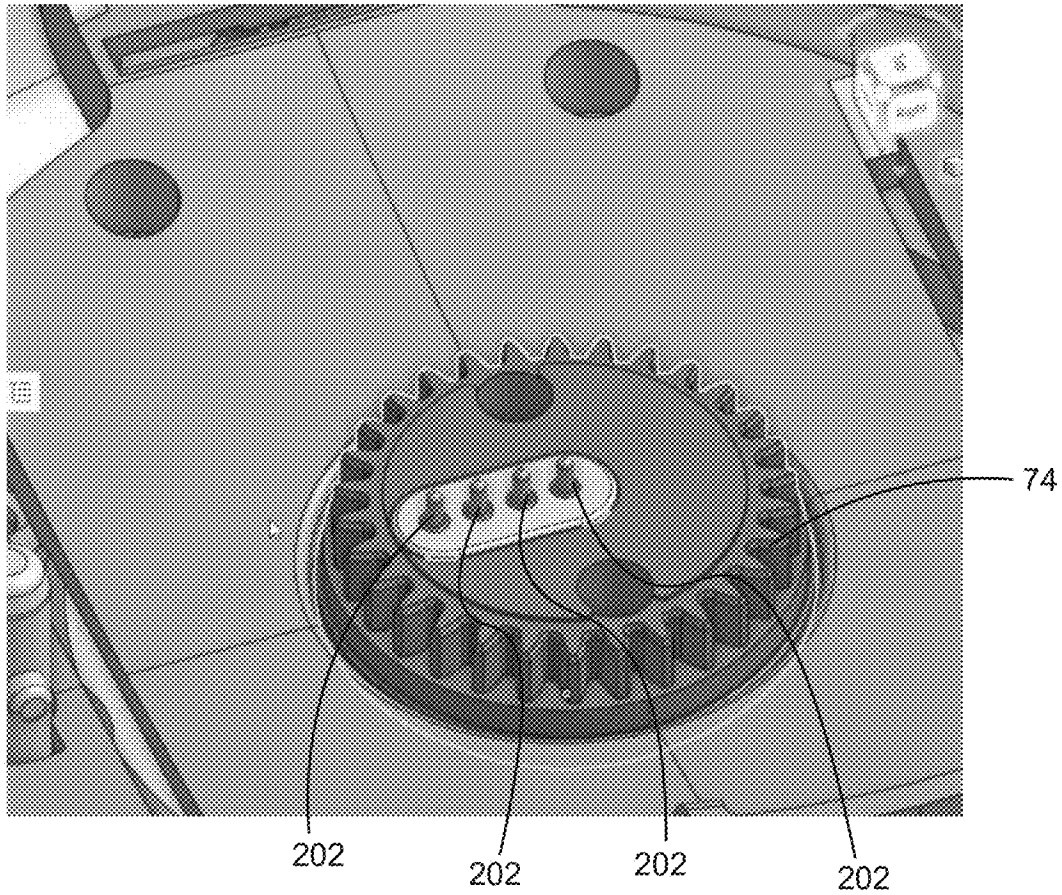
FIG. 29 is a magnified perspective view of the housing contacts from the housing.

In order to receive signals from the housing sensor 154, and in order to power any such sensors that require power, without providing separate battery for the housing 12 and a separate battery (i.e. battery 26) for the inner object 14, the toy assembly 10 may include a sliding electrical connection between the inner object 14 and the housing 12. The sliding electrical connection is shown generally at 200 in FIGS. 28 and 29. The sliding electrical connection 200 includes a plurality of a plurality of housing contacts 202, and a plurality of inner object contacts 204. The plurality of housing contacts 202 may be positioned anywhere suitable on the housing, such as on the sun gear 74. At least one electrical biasing member 206 may be included in the toy assembly 10 and is positioned to urge the plurality of housing contacts 202 and the plurality of inner object contacts 204 into engagement with one another. In the embodiment shown the at least one electrical biasing member 206 is positioned in the housing 12 to urge the plurality of housing contacts 202 into engagement with the plurality of inner object contacts 204. In the embodiment shown, the at least one electrical biasing member 206 includes a compression spring (represented in FIG. 28 as a C-shaped resilient member) for each one of the plurality of housing contacts 202. However, it will be understood that any suitable structure for urging the housing contacts 202 and the inner object contacts 204 into engagement with one another may be used. For example, the housing contacts 202 themselves may be upward projects from horizontal arms that are resilient and which are cantilevered and which extend underneath the sun gear 74.

The inner object contacts 204 and the housing contacts 202 may be any suitable types of contacts. For example, one of the inner object contacts 204 and the housing contacts 202 may be electrical paths on a substrate and the other of the inner object contacts 204 and the housing contacts 202 may be pins that engage the electrical paths. In the embodiment shown, the inner object contacts 204 are electrical paths on a substrate and the housing contacts 202 are pins that engage the electrical paths, although the opposite is possible. Each of the electrical paths may extend in a circular arc, such that, during rotation of the inner object 14 in the housing 12 during the breakout process, the pins travel along the circular arcs to remain in contact with the electrical paths. The radially innermost pin and the corresponding electrical path may be concentric with the axis of rotation of the inner object 14 and thus, simply rotate in place to maintain engagement with its associated electrical path.

Figure 21:
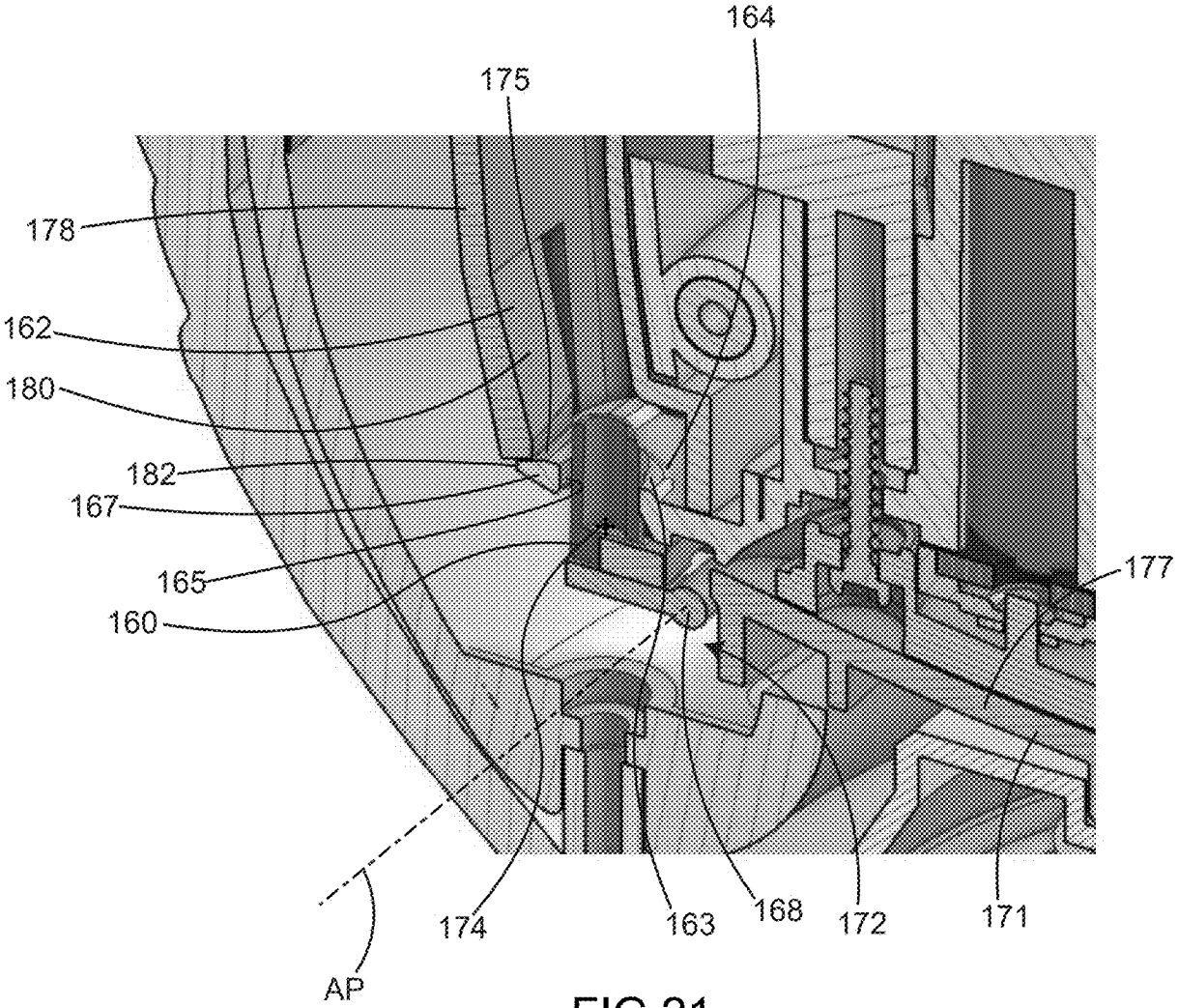
FIG. 21 is a magnified sectional perspective view of a portion of the housing and the inner object, to show a first latching member and a second latching member that are used to hold the inner object in the housing, wherein the first and second latching members are both in locking positions.

The housing 12 includes a first latching member 160 and a second latching member 162. The first latching member 160 is movable between an unlocking position for the first latching member 160 (FIG. 22) and a locking position for the first latching member (FIG. 21). In the unlocking position for the first latching member 160, the first latching member 160 permits removal of the inner object 14 from the housing 12. In the locking position for the first latching member 160, the first latching member 160 engages a first latching member engagement surface 164 on the inner object 14 to prevent removal of the inner object 14 from the housing 12. The first latching member 160 may have any suitable shape, such as a split arrowhead shape having at least one first locking shoulder 163, and extending through an aperture 165 in a locking projection 167 of the inner object 14, which has the first latching member engagement surface 164 thereon. Compression of the split arrowhead shape (e.g. by the user) disengages the first latching member 160 from the first latching member engagement surface 164 and permits the first latching member 160 to fit through the aperture 165 thereby moving to the unlocking position for the first latching member 160.

The housing 12 may further include a first latching member holding member 168 that holds the first latching member 160 in the unlocking position for the first latching member 160, so as to inhibit the first latching member 160 from moving to the locking position for the first latching member 160 after moving to the unlocking position for the first latching member 160.

In the embodiment shown, the first latching member 160 is pivotably mounted to a first latching member support member 170 by a pivot joint 172 for pivoting movement about a first latching member pivot axis AP. The first latching member 160 has a first latching member center of gravity 174. The first latching member pivot axis AP is on a first side of the first latching member center of gravity 174 such that, upon disengagement from the first latching member engagement surface 164, the first latching member 160 falls away to the unlocking position for the first latching member 160, and is held in the unlocking position for the first latching member 160 because the position of the pivot axis AP relative to the first latching member center of gravity 174 results in a moment applied by gravity holding the first latching member 160 in the unlocking position. Thus, the pivot joint 172 may be considered to be the first latching member holding member 168.

The first latching member support member 170 may be a portion of an inner object support member 171 that supports the inner object 14 in the housing 12.

Figure 22:
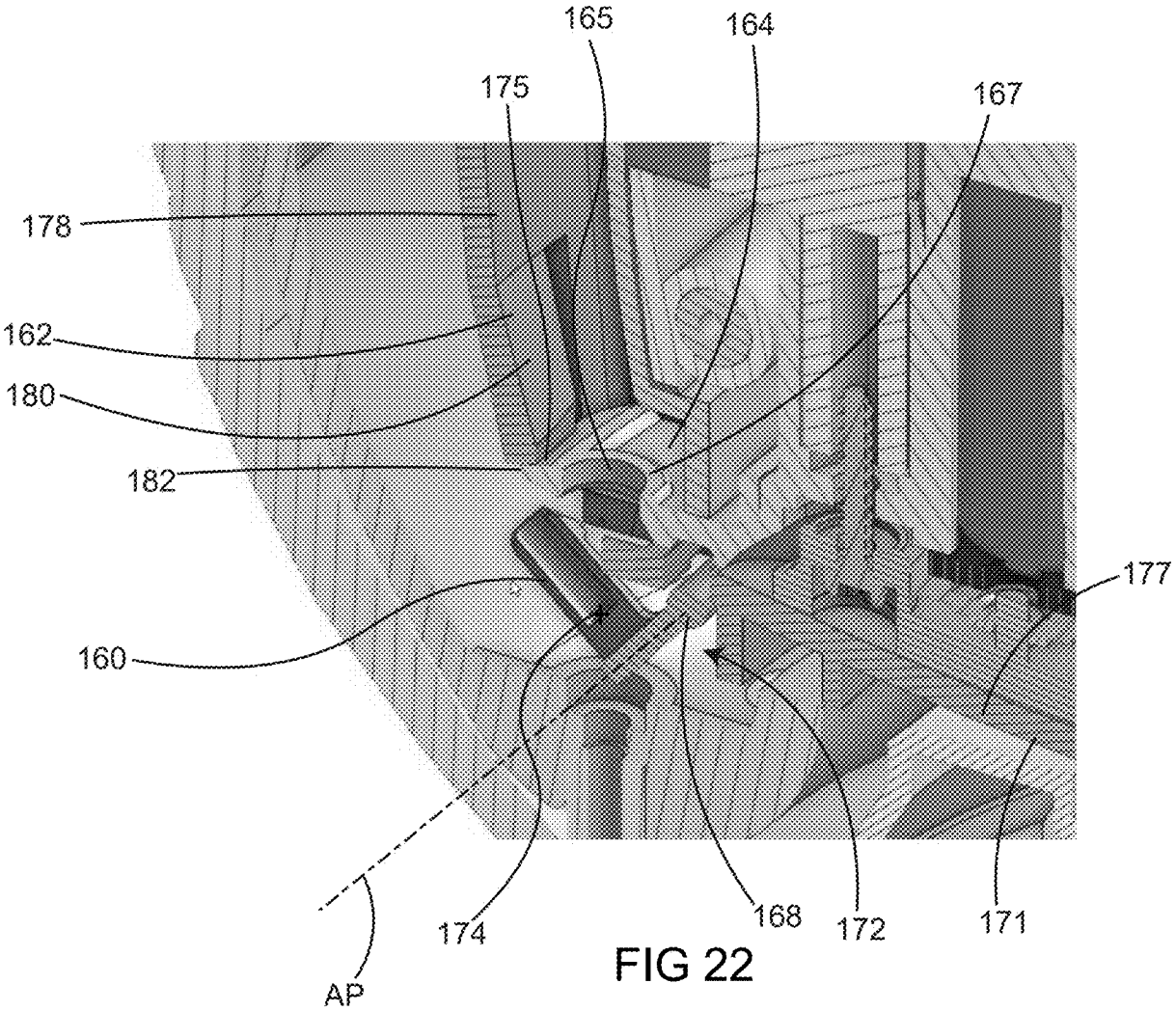
FIG. 22 is a magnified sectional perspective view of the portion of the housing and the inner object shown in FIG. 21, showing the first latching member in the unlocking position and the second latching member in the locking position.
Figure 23:
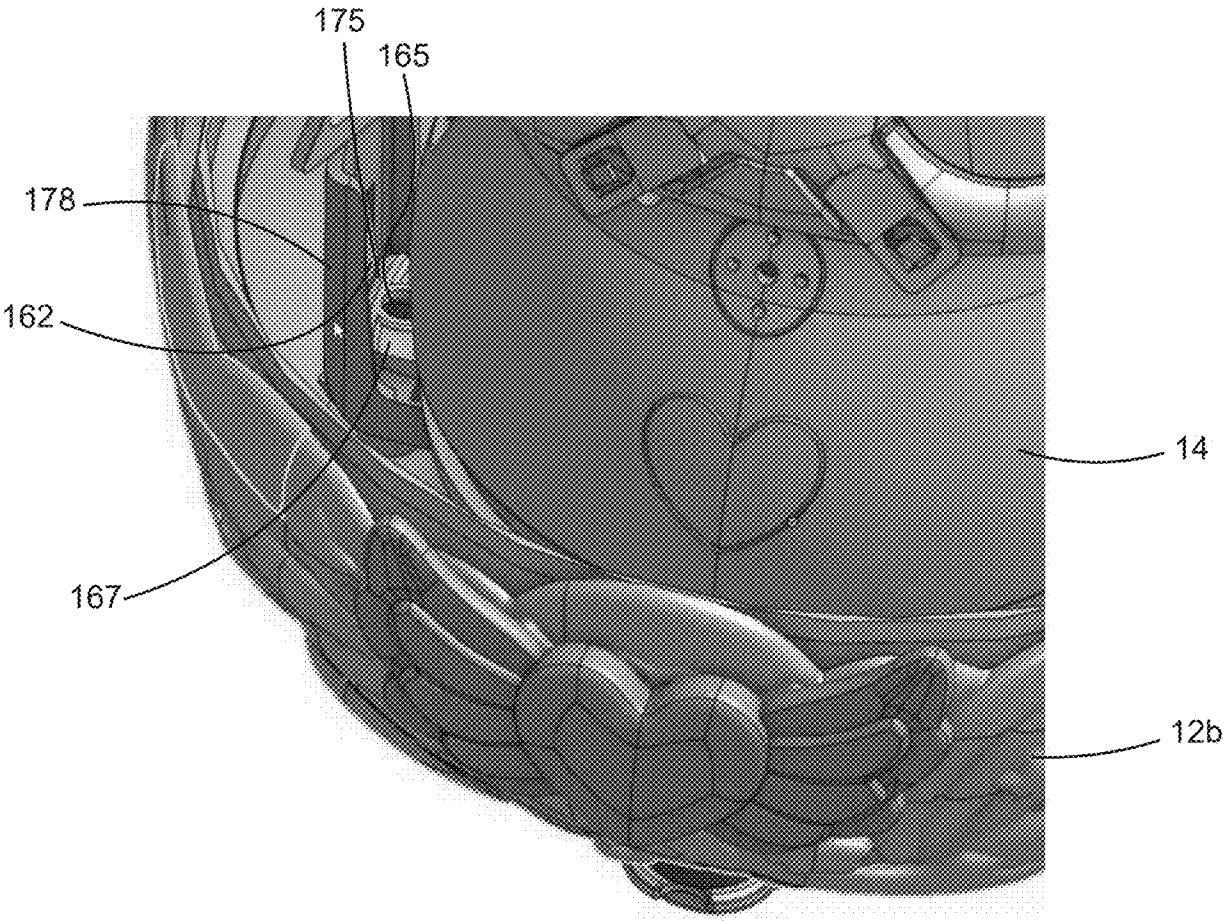
FIG. 23 is a perspective view of a portion of the housing and the inner object showing the engagement of the second latching member with a locking projection on the inner object.

The second latching member 162 is movable between an unlocking position for the second latching member 162 (represented in dashed line outline shown at 164 in FIG. 24) and a locking position for the first latching member 160 (FIGS. 21, 22 and 23). In the unlocking position for the second latching member 162, the second latching member 162 permits removal of the inner object 14 from the housing 12. In the locking position for the second latching member 162, the second latching member 162 engages a second latching member engagement surface 175 on the inner object 14 to prevent removal of the inner object 14 from the housing 12. The second latching member engagement surface 175 may also be on the locking projection 167 on the inner object 14.

Figure 24:
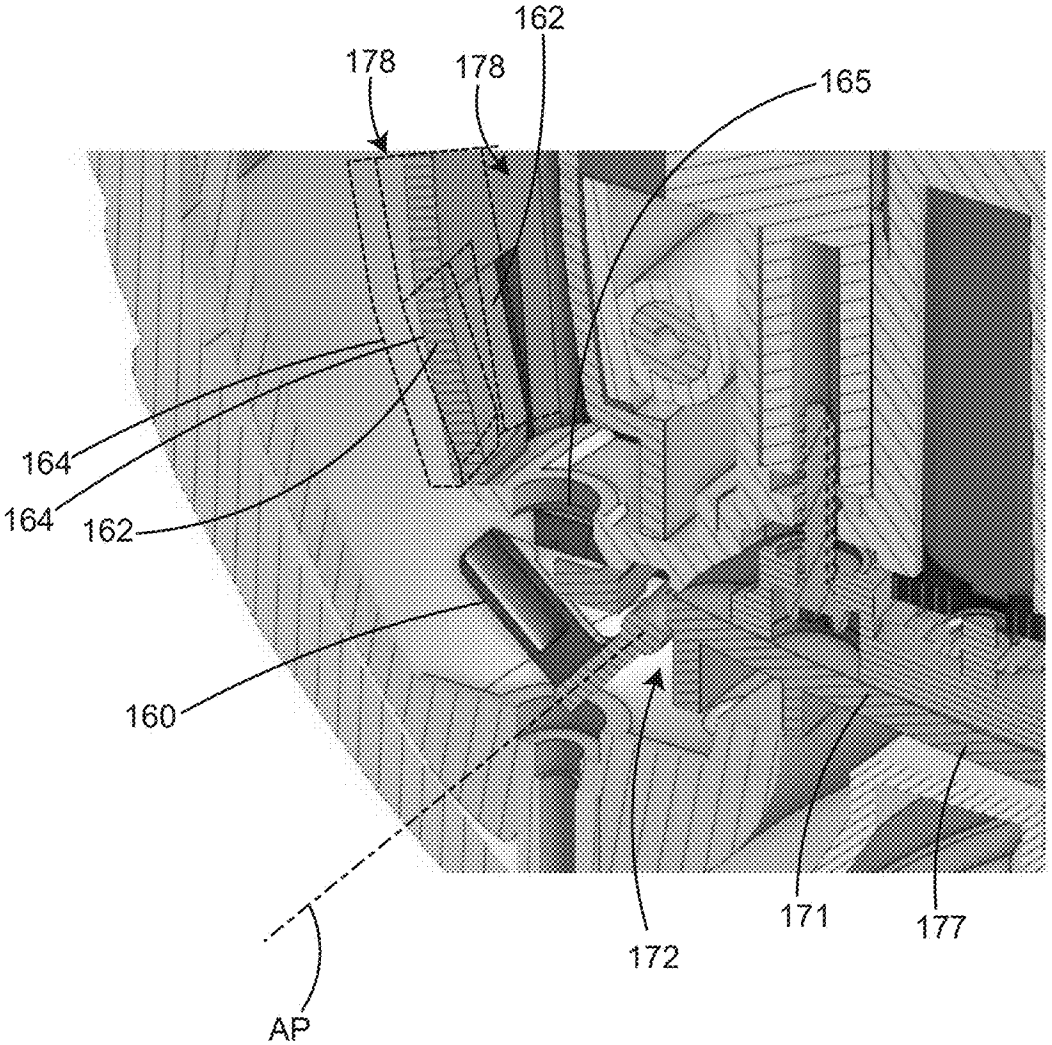
FIG. 24 is a magnified sectional perspective view of the portion of the housing and the inner object shown in FIG. 21, showing the first and second latching members both in the unlocking position.
Figure 25:
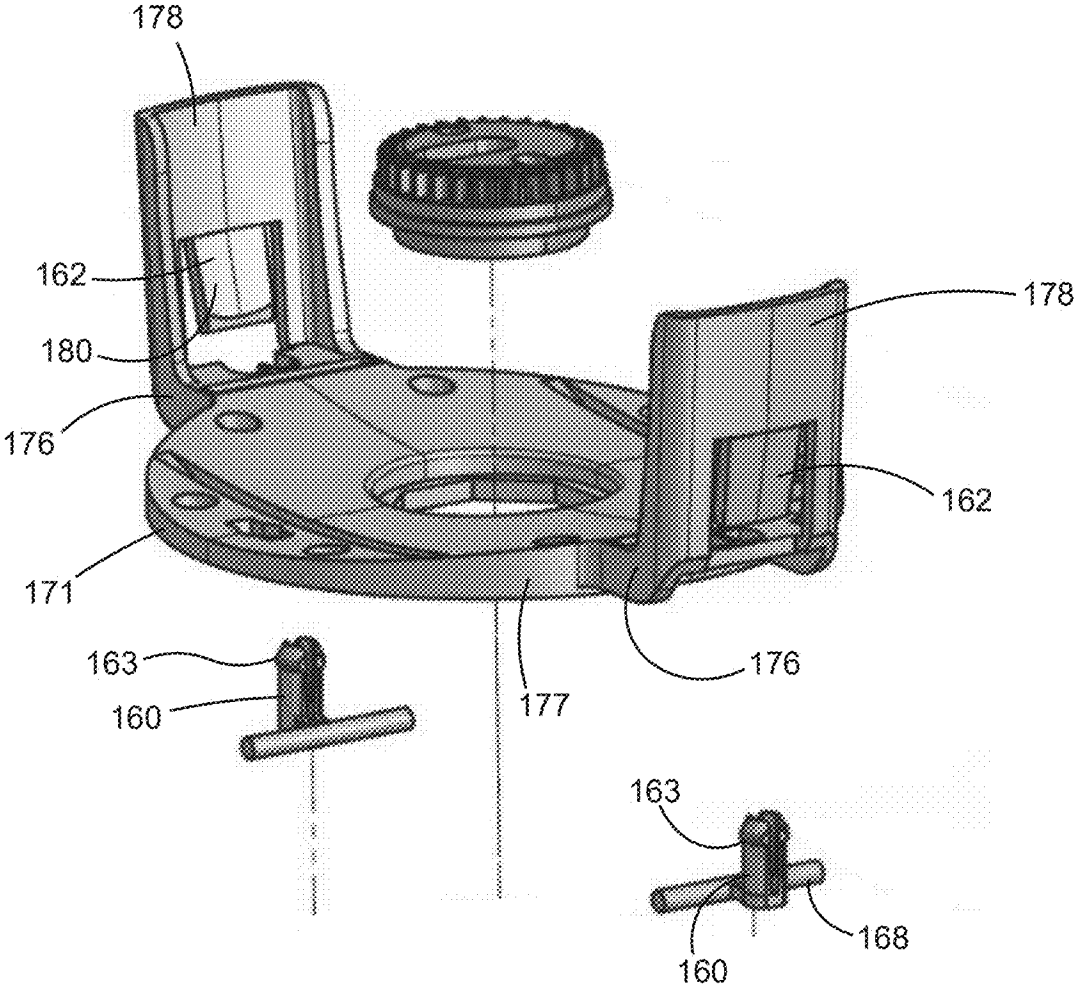
FIG. 25 is a perspective exploded view the first and second latching members and a sun gear that is in the housing.

The housing 12 may further include a second latching member biasing member 176 that urges the second latching member 162 towards the locking position for the second latching member 162, so as to move towards the locking position for the second latching member 162 after moving to the unlocking position for the second latching member 162. In the embodiment shown, the second latching member biasing member 176 is integrally connected to the second latching member 162. More specifically, the second latching member 162 may be a tongue that engages the second latching member engagement surface 175. The tongue may extend from an arm 178 that extends from a main portion 177 of the inner object support member 171. The arm 178 may be resiliently flexible and may be flexed (e.g. by the user) so as to move the second latching member 162 to the unlocking position for the second latching member 162 as shown in FIG. 24, whereat the second latching member 162 is disengaged from the second latching member engagement surface 175, so as to permit removal of the inner object 14 from the housing 12. The arm 178 may be considered to be the second latching member biasing member 176.

The first latching member 160 may be a first of a plurality of first latching members 160. Thus, the housing 12 may include at least one first latching member 160. Additionally or alternatively, the second latching member 162 may be a first of a plurality of second latching members 162. Thus, the housing 12 may include at least one second latching member 162. In the embodiment shown, the housing includes two first latching members 160 and two second latching members 162, and the inner object 14 has two first latching member engagement surfaces 164 and two second latching member engagement surfaces 175 (positioned on two locking projections 167).

Providing the at least one first latching member 160 and the at least one second latching member 162 may be advantageous in order to hold the inner object 14 in the housing 12 during shipping of the toy assembly 10 from a manufacturing facility to its place in a warehouse or on a store shelf, and from one of these places to the home of the user. By contrast the at least one first latching member 160 or the at least one second latching member 162 may not have been sufficiently strong to serve this function. However, once the toy assembly 10 is in the home of the user, it does not need to be held to the housing 12 as strongly as prior to its shipment from the manufacturing facility. In the present embodiment, the first latching member 160 is no longer used to secure the inner object 14 in the housing 12 after the inner object 14 is first removed from the housing 12. The inner object 14 may be inserted into place in the inner object support member 171 and may latch into place thereon automatically by engagement with the second latching members 162, which is sufficiently strong to hold the inner object 14 in the housing 12 in a home environment but which may not by itself be strong enough to hold the inner object 14 during transport of the toy assembly 10 after having been manufactured. As a result, after the initial use of the toy assembly 10 by the user, in which the user unlocks the first latching member 160 or the first latching members 160 (depending on the specific toy assembly being made), and they remain unlocked, the user can more easily insert the inner object 14 back into the base 12*b* and subsequently remove the inner object 14 from the base 12*b* when desired, since only the second latching member 162 (or second latching members 162) is/are holding the inner object 14 in place.

Figure 27:
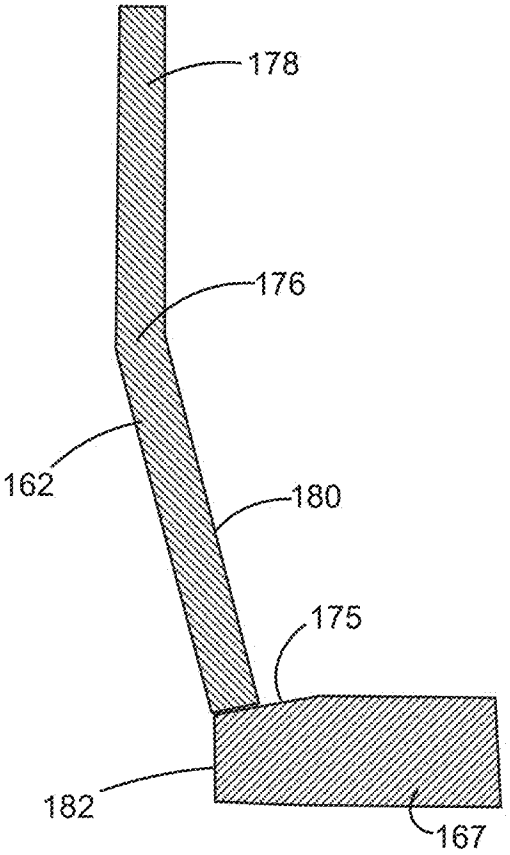
FIG. 27 is a side sectional view of the second latching member and the locking projection after insertion of the inner object in the housing.
Figure 26:
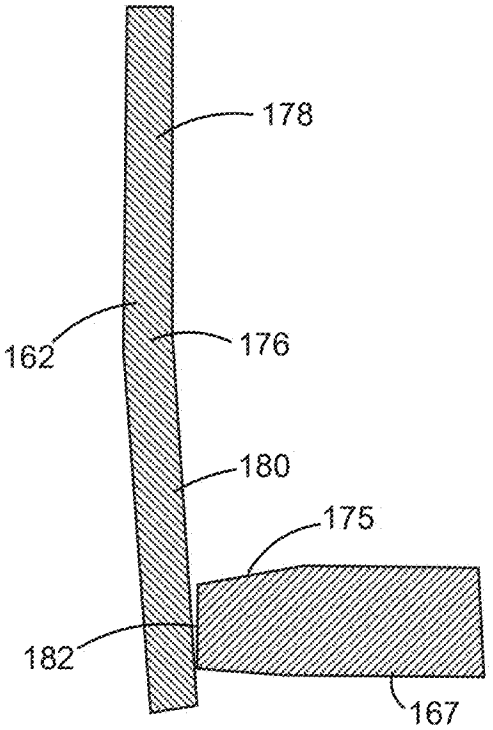
FIG. 26 is a side sectional view of the second latching member and the locking projection during insertion of the inner object in the housing.

The automatic latching of the inner object 14 into place may take place by any suitable structure. For example, as shown best in FIGS. 26 and 27, the second latching member 162 may include a driven surface 180, and the inner object 14 has a latching member driver surface 182. The latching member driver surface 182 is positioned to engage the driven surface 180 to drive the second latching member 162 away from the locking position for the second latching member 162 during insertion of the inner object 14 towards a mounted position in the base 12*b* (and more particularly in the inner object support member 171). The latching member driver surface 182 is positioned to disengage from the driven surface 180 upon the inner object 14 reaching the mounted position (as shown in FIG. 22), so as to permit the second latching member biasing member 162 to drive the second latching member 162 to the locking position for the second latching member 162 (by virtue of the resiliency of the arm 178). It will be noted that it may be a resiliency of a different portion of the arm 178 that is resiliently flexed when the second latching member 162 is being pushed out of the way by the second latching member driver surface 182 than is resiliently flexed when the user moves the arm 178 to bring the second latching member 162 out of the way during removal of the inner object 14. For example, the joint between the second latching member 162 and the arm 178 is flexed when the second latching member 162 is being pushed by the second latching member driver surface 182, and may thus constitute the second latching member biasing member 176 in some situations. However, it is the joint between the arm 178 and the main portion 177 of the inner object support member 171 which flexes, and may thus constitute the second latching member biasing member 176 in some other situations.

It will be noted that the inner object support member, which is latched to the inner object by way of the first and second latching members 160 and 162 is rotatably mounted in the housing 12, and is rotatable with the inner object 14. Thus, the sun gear 74, which is fixedly mounted to the housing 12 is entirely separate from the inner object support member 171.

In addition to the first and second latching members 160 and 162, which hold the inner object 14 in the housing 12, the toy assembly 10 may further include a plurality of retainer clips shown at 210. The retainer clips 210 are used to hold the toy assembly 10 in place in whatever packaging it comes in. Additionally, a first one of the retainer clips 210 may also engage a limit switch (shown at 212 in FIG. 14) that controls whether a circuit can be closed in the inner object 14. More specifically, the limit switch 212, when engaged by one of the retainer clips 210, keeps an associated circuit (not shown) open, thereby preventing the toy assembly 10 from being activated (by preventing current from flowing from the battery 26) during transport of the toy assembly 10 prior to sale to a user. When the retainer clip 210 is removed, the limit switch 212 springs out, which closes the associated circuit, thereby permitting activation of the toy assembly 10 (by permitting current flow from the at least one battery 26).

Additional elements that may optionally be provided include a microphone 214 shown in FIGS. 6 and 7, which is electrically connected to the PCB 132 and is another example of the at least one sensor 152. In other words, the user can make a noise or say something, which is sensed by the microphone 214, which transmits signals to the control system 130, such that the processor 134 may activate an output member such as a motor such as the motor 17, the speaker 190, at least one light emitting element such as the at least one light emitting element 138, or any combination of two or more of these aforementioned output members, depending on what is sensed by the microphone 214. The microphone 214 is an example of the at least one sensor 152, and is furthermore an example of the at least one inner object sensor 155.

Another example of the at least one sensor 152 and the at least one inner object sensor 155 is a pushbutton 216 shown in FIGS. 2, 5 and 6. The pushbutton 216 may be in the shape of a heart, as shown, on the front 14*a* of the inner object 14. However, the pushbutton 216 may be any other suitable shape. The pushbutton 216 may be pressable to close a switch shown at 218 in FIG. 7, by pushing a first pushbutton contact against a second pushbutton contact, as is well known in the art of pushbuttons. As a result, a signal is sent to the control system 130, and the processor 134 may be programmed to illuminate a pushbutton light emitting element 224.

The toy assembly may further include other optional features such as, for example, a smoke generator 226. The smoke generator 226 may be any suitable fog generator known in the art, and may be electrically connected to the PCB 132 and is controlled by the processor 134, so as to generate smoke upon initiation by the processor 134, based on the processor 134 determining that a suitable condition has been met.

While not shown, it will be noted that the inner object 14 may be covered in a surface material. The surface material may be any suitable material such as a plush material.

The use of the toy assembly 10 and the breakout process are described as follows. The user first removes the toy assembly 10 from its packaging and removes the retainer clips 210. The user may begin interacting with the toy assembly 10 by holding it, patting it, manipulating it (e.g. holding it upside down or sideways), speaking to it or any other suitable type of interaction. Once the control system 130 has determined that a selected condition has been met, it will initiate a breakout process. In the breakout process, the motor 17 is driven to drive the breakout member 16 out to break the housing 12 (FIG. 31), and then to retract the breakout member 16 (FIG. 30), and to rotate the inner object 14 to a new position (FIG. 14) in the housing 12. These steps may be repeated a selected number of times. Optionally, the control system 130 will stop the breakout process and will require the user to continue to interact with the toy assembly 10 in selected ways until additional conditions are determined to have been met, in order to continue the breakout process. At any suitable point, prior to, during or after the breakout process, it is possible that the control system 130 will illuminate the at least one light emitting element 138 so as to illuminate the first housing member 12*a*, and may additionally or alternatively initiate operation of the smoke generator to create a smoky appearance inside the housing 12. If the housing 12 has been broken by the breakout member 16 already (e.g. if there are one or more holes in the housing 12 already), the smoke can escape from the housing 12 providing an additional visual effect to the breakout process. During the breakout process, the control system 130 may play sounds through the speaker 190.

Once the breakout process is complete, the user may remove the portion of the first housing member 12*a* that may still be obstructing removal of the inner object 14. The user may then disengage the first latching members 160 (e.g. by pushing the first latching members 160 down out of the way) and may disengage the second latching members 162 (e.g. by spreading the arms 178 away from the inner object 14). The user may then remove the inner object 14 from the housing 12, and may interact with the inner object 14 via any suitable input such as speaking to it, manipulating it, and/or engaging sensors such as the contact sensor that may be provided on the head 22 of the inner object 14.

Persons skilled in the art will appreciate that there are yet more alternative implementations and modifications possible, and that the above examples are only illustrations of one or more implementations. The scope, therefore, is only to be limited by the claims appended hereto.

Example concepts that are disclosed herein include:

Concept 1. A toy assembly, comprising:

a housing, wherein the housing includes a first housing member and a second housing member, wherein the first housing member is light transmissive to an exterior of the housing, and a light transfer member having a light inlet and a light outlet, wherein the light outlet is positioned to direct light into the first housing member so as to render the light visible from the exterior of the housing;

an inner object inside the housing, wherein the inner object is removable from the housing;

at least one sensor that detects interaction by a user with the housing;

at least one light emitting element positioned on the inner object and which is not visible from the exterior of the housing, wherein the at least one light emitting element is positioned to direct light at the light inlet of the light transfer member so as to transmit the light through the light transfer member into the first housing member and through the first housing member so as to be visible from the exterior of the housing; and a control system that includes a processor and a memory connected to the processor, wherein the processor is programmed to execute instructions stored in the memory, to determine whether a selected condition has been met based on signals from the at least one sensor, and to operate the at least one light emitting element if the condition is met.

Concept 2. A toy assembly as described in concept 1, wherein the light transfer member is arcuate between the light inlet and the light outlet, such that the light inlet is oriented to direct the light in a first direction into the light transfer member and the light outlet is oriented to direct the light in a second direction that is different than the first direction.

Concept 3. A toy assembly as described in concept 1, wherein the at least one light emitting element is a plurality of light emitting elements.

Concept 4. A toy assembly as described in concept 1, wherein the light transfer member is made from a light transfer material with a selected index of refraction and which is shaped to transmit light therethrough from the light inlet to the light outlet using total internal reflection.

Concept 5. A toy assembly as described in concept 4, wherein the light inlet of the light transfer member has a first surface area and the light outlet of the light transfer member has a second surface area that is larger than the first surface area, and the light transfer member is shaped to permit the light to diverge between the light inlet and the light outlet.

Concept 6. A toy assembly as described in concept 1, wherein the housing is in the form of an egg.

Concept 7. A toy assembly as described in concept 1, wherein the second housing member is a base of the egg which is opaque, and the first housing member is an upper portion of the egg that extends above the second housing member.

Concept 8. A toy assembly, comprising:

a housing;

an inner object inside the housing, wherein the inner object is removable from the housing, and includes a breakout member;

a motor that includes a motor output shaft that is rotated at a motor output speed that is greater than 4000 rpm; and a drive train that includes:

a drive pulley that is mounted to the motor output shaft, a driven pulley, a belt that extends between the drive pulley and the driven pulley, wherein the drive pulley and the driven pulley have a size ratio such that the driven pulley rotates at a driven pulley speed that is less than 4000 rpm, anD a gear train that includes a plurality of gears including at least a first gear that co-rotates with the driven pulley, and a final gear that is driven at least indirectly by the first gear, wherein the plurality of gears all rotate at speeds that are less than 4000 rpm, wherein the final gear is operatively connected to the breakout member; and wherein operation of the motor drives the breakout member through the drivetrain, to move between a retracted position and an extended position in order to break the housing so as to expose the inner object.

Concept 9. A toy assembly as described in concept 8, wherein the motor output speed is between 11500 rpm and 12500 rpm.

Concept 10. A toy assembly as described in concept 8, wherein the plurality of gears are polymeric.

Concept 11. A toy assembly as described in concept 8, wherein the housing is in the form of an egg.

Concept 12. A toy character, comprising:

a toy character housing, defining a vertical axis, wherein the toy character housing includes a ground engagement surface that permits tipping of the toy character;

a motor;

a weighted arm with a weight thereon, wherein the weighted arm is movable to change a distance of the weight relative to the vertical axis;

a weighted arm driver; and a weighted arm cam path, and a weighted arm cam path engagement member, wherein one of the weighted arm cam path and the weighted arm cam path engagement member is connected to the weighted arm, and the other of the weighted arm cam path and the weighted arm cam path engagement member is connected to the weighted arm driver, wherein the motor is operatively connected to the weighted arm driver, such that rotation of the motor by a first amount in a first direction drives movement of the weighted arm driver, which in turn drives movement of the weighted arm cam path engagement member along a first portion of the weighted arm cam path, so as to move the weighted arm and the weight so as to move a center of gravity for the toy character to a first position that causes tipping of the toy character in a first tipping direction, and wherein continued rotation of the motor by a second amount beyond the first amount in the first direction drives movement of the weighted arm driver, which in turn drives movement of the weighted arm cam path engagement member along a second portion of the weighted arm cam path, so as to move the weighted arm and the weight so as to move the center of gravity for the toy character to a second position that causes tipping of the toy character in a second tipping direction.

Concept 13. A toy character as described in concept 12, wherein the weighted arm cam path is on the weighted arm driver and the weighted arm cam path engagement member is on the weighted arm.

Concept 14. A toy character as described in concept 12, wherein the ground engagement surface of the toy character housing is arcuate in a vertical plane.

Concept 15. A toy character as described in concept 12, wherein the toy character has a front, a rear, a first side and a second side, and wherein the vertical plane extends laterally, wherein the weighted arm is movable to change the distance of the weight laterally relative to the vertical axis, and wherein the first tipping direction is a first lateral direction and the second tipping direction is a second lateral direction.

Concept 16. A toy assembly, comprising:

a housing, wherein the housing includes a sun gear that is fixed in position and which defines an axis;

an inner object inside the housing, wherein the inner object is removable from the housing, and includes a breakout member;

a leadscrew;

a leadscrew nut that is movably linearly along the leadscrew during rotation of the leadscrew;

a planet gear that is engaged with the sun gear and is rotatable to drive rotation of the inner object about the axis;

a rotary function shaft that has a first end that is operatively engaged with the planet gear, and a second end that includes at least one shaft tooth;

a plunger having a first end and a second end, wherein the plunger includes at least one plunger tooth at the first end, wherein the at least one plunger tooth is releasably engageable with the at least one shaft tooth to operatively connect the plunger to the rotary function shaft, wherein the plunger is axially slidable relative to the leadscrew but is rotationally connected to the leadscrew;

a plunger biasing member that is positioned to urge the plunger from a shaft engagement position in which the at least one plunger tooth is engaged with the at least one shaft tooth, towards a shaft release position in which the at least one plunger tooth is disengaged from the at least one shaft tooth; anD a carriage that is connected to the leadscrew nut, and is connected to the breakout member, wherein rotation of the leadscrew in a first leadscrew direction drives the leadscrew nut linearly in a first nut direction, which in turn drives the carriage away from the plunger, permitting the plunger biasing member to drive the plunger to the shaft release position, thereby disconnecting the plunger from driving rotation of the planet gear, but driving movement of the breakout member to engage the housing to break the housing, and wherein rotation of the leadscrew in a second leadscrew direction drives the leadscrew nut in a second nut direction, which in turn drives the carriage towards the plunger, driving the plunger to the shaft engagement position, thereby operatively connecting the plunger to drive rotation of the planet gear so as to rotate the inner object from a first rotational position to a second rotational position in the housing; and a motor that is operatively connected to the leadscrew for driving rotation of the leadscrew in the first and second directions.

Concept 17. A toy assembly, comprising:

a housing;

an inner object inside the housing, wherein the inner object is removable from the housing, and includes a first functional element that is movable linearly between a retracted position and an extended position to carry out a first function while the inner object is in the housing;

a leadscrew;

a leadscrew nut that is movably linearly along the leadscrew during rotation of the leadscrew;

a second functional element that is rotatable and is movable via rotation from a first rotary position to a second rotary position to carry out a second function while the inner object is in the housing;

a rotary function shaft that has a first end that is operatively engaged with the second functional element, and a second end that includes at least one shaft teeth;

a plunger having a first end and a second end, wherein the plunger includes at least one plunger tooth at the first end, wherein the at least one plunger tooth is releasably engageable with the at least one shaft tooth to operatively connect the plunger to the rotary function shaft, wherein the plunger is axially slidable relative to the leadscrew but is rotationally connected to the leadscrew;

a plunger biasing member that is positioned to urge the plunger from a shaft engagement position in which the at least one plunger tooth is engaged with the at least one shaft tooth, towards a shaft release position in which the at least one plunger tooth is disengaged from the at least one shaft tooth; and a carriage that is connected to the leadscrew nut, and is connected to the first functional element, wherein the carriage is movable between a first carriage position and a second carriage position, wherein rotation of the leadscrew in a first leadscrew direction drives the leadscrew nut in a first nut direction, which in turn drives the carriage away from the first carriage position to the second carriage position, and away from the plunger, permitting the plunger biasing member to drive the plunger to the shaft release position, thereby disconnecting the plunger from driving rotation of the second functional element, and wherein movement of the carriage to the second carriage position drives movement of the first functional element linearly to the extended position, and wherein rotation of the leadscrew in a second leadscrew direction drives the leadscrew nut in a second nut direction, which in turn drives the carriage to the first carriage position thereby driving the first functional element to the retracted position, and which drives the carriage to drive the plunger to the shaft engagement position, which operatively connects the plunger to the second functional element to drive rotation of the second functional element to move the second functional element from the first rotary position for the second functional element to the second rotary position for the second functional element, so as to carry out the second function; and a motor that is operatively connected to the leadscrew for driving rotation of the leadscrew in the first and second leadscrew directions.

Concept 18. A toy assembly as described in concept 17, wherein movement of the first functional element to the extended position carries out the first function.

Concept 19. A toy assembly as described in concept 18, wherein the first functional element is a breakout member, and the first function is to impact the housing with the breakout member so as to break the housing to expose the inner object.

Concept 20. A toy assembly as described in concept 19, wherein the second functional element is a gear, and the second function is to move the inner object from a first orientation in the housing to a second orientation in the housing.

Concept 21. A toy assembly as described in concept 17, wherein the housing is in the form of an egg.

Concept 22. A toy assembly, comprising:

a housing including a base and an upper member;

an inner object inside the housing, wherein the inner object is removable from the housing;

wherein the housing includes a first latching member that is movable between an unlocking position for the first latching member and a locking position for the first latching member, wherein in the unlocking position first latching member, the first latching member permits removal of the inner object from the housing, and wherein, in the locking position for the first latching member, the first latching member engages a first latching member engagement surface on the inner object to prevent removal of the inner object from the housing, wherein the housing includes a second latching member that is movable between an unlocking position for the second latching member and a locking position for the second latching member, wherein in the unlocking position second latching member, the second latching member permits removal of the inner object from the housing, and wherein, in the locking position for the second latching member, the second latching member engages a second latching member engagement surface on the inner object to prevent removal of the inner object from the housing, wherein the housing further includes a first latching member holding member that holds the first latching member in the unlocking position for the first latching member, so as to inhibit the first latching member from moving to the locking position for the first latching member after moving to the unlocking position for the first latching member, wherein the housing further includes a second latching member biasing member that urges the second latching member towards the locking position for the second latching member, so as to move towards the locking position for the second latching member after moving to the unlocking position for the second latching member, wherein the second latching member includes a driven surface, and wherein the inner object has a driver surface, wherein the driver surface is positioned to engage the driven surface to drive the second latching member away from the locking position for the second latching member during insertion of the inner object towards a mounted position in the base, and wherein the driver surface is positioned to disengage from the driven surface upon the inner object reaching the mounted position, so as to permit the second latching member biasing member to drive the second latching member to the locking position for the second latching member.

Concept 23. A toy assembly as described in concept 22, wherein the first latching member is pivotably mounted to a first latching member support member by a pivot joint for pivoting movement about a first latching member pivot axis, and wherein the first latching member has a first latching member center of gravity and the first latching member pivot axis is on a first side of the first latching member center of gravity such that, upon disengagement from the first latching member engagement surface, the first latching member falls away to the unlocking position for the first latching member, and is held in the unlocking position for the first latching member.

Concept 24. A toy assembly as described in concept 22, wherein the second latching member biasing member is integrally connected to the second latching member.

Concept 25. A toy assembly as described in concept 22, wherein the upper member of the housing is made from a breakable material, and wherein the inner object includes a breakout member that is movable by a motor between a retracted position and an extended position in order to break the upper member of the housing to expose the inner object, and wherein the base of the housing is made from a base material that is unbreakable by movement of the breakout member between the retracted position and the extended position by the motor.

Other concepts are also disclosed herein, for which protection is being sought.

What is claimed is:

1. A toy assembly, comprising:

a housing, wherein the housing includes a first housing member and a second housing member, wherein the first housing member is light transmissive to an exterior of the housing, and a light transfer member having a light inlet and a light outlet, wherein the light outlet is positioned to direct light into the first housing member so as to render the light visible from the exterior of the housing;

an inner object inside the housing, wherein the inner object is removable from the housing;

at least one sensor that detects interaction by a user with the housing;

at least one light emitting element positioned on the inner object and which is not visible from the exterior of the housing, wherein the at least one light emitting element is positioned to direct light at the light inlet of the light transfer member so as to transmit the light through the light transfer member into the first housing member and through the first housing member so as to be visible from the exterior of the housing; and a control system that includes a processor and a memory connected to the processor, wherein the processor is programmed to execute instructions stored in the memory, to determine whether a selected condition has been met based on signals from the at least one sensor, and to operate the at least one light emitting element if the condition is met.

2. The toy assembly as claimed in claim 1, wherein the light transfer member is arcuate between the light inlet and the light outlet, such that the light inlet is oriented to direct the light in a first direction into the light transfer member and the light outlet is oriented to direct the light in a second direction that is different than the first direction.

3. The toy assembly as claimed in claim 1, wherein the at least one light emitting element is a plurality of light emitting elements.

4. The toy assembly as claimed in claim 1, wherein the light transfer member is made from a light transfer material with a selected index of refraction and which is shaped to transmit light therethrough from the light inlet to the light outlet using total internal reflection.

5. The toy assembly as claimed in claim 4, wherein the light inlet of the light transfer member has a first surface area and the light outlet of the light transfer member has a second surface area that is larger than the first surface area, and the light transfer member is shaped to permit the light to diverge between the light inlet and the light outlet.

6. The toy assembly as claimed in claim 1, wherein the housing is in a form of an egg.

7. The toy assembly as claimed in claim 6, wherein the second housing member is a base of the egg which is opaque, and the first housing member is an upper portion of the egg that extends above the second housing member.

* * * * *